US010993302B2

(12) United States Patent
Freer et al.

(10) Patent No.: US 10,993,302 B2
(45) Date of Patent: Apr. 27, 2021

(54) POWER REGULATION FOR LIGHTING FIXTURES

(71) Applicant: EATON INTELLIGENT POWER LIMITED, Dublin (IE)

(72) Inventors: Benjamin Avery Freer, Syracuse, NY (US); Andrew Francis Scarlata, West Monroe, NY (US)

(73) Assignee: Eaton Intelligent Power Limited, Dublin (IE)

( * ) Notice: Subject to any disclaimer, the term of this patent is extended or adjusted under 35 U.S.C. 154(b) by 231 days.

(21) Appl. No.: 15/880,426

(22) Filed: Jan. 25, 2018

(65) Prior Publication Data

US 2018/0213621 A1 Jul. 26, 2018

Related U.S. Application Data

(60) Provisional application No. 62/450,168, filed on Jan. 25, 2017.

(51) Int. Cl.
*H05B 45/37* (2020.01)
*H05B 45/10* (2020.01)
*H05B 45/48* (2020.01)

(52) U.S. Cl.
CPC ..... *H05B 45/37* (2020.01); *H05B 45/10* (2020.01); *H05B 45/48* (2020.01)

(58) Field of Classification Search
CPC ..... H05B 33/0815; H05B 33/083; H05B 33/0851; H05B 33/0854; H05B 45/10; H05B 45/37; H05B 45/48
USPC ..... 307/19
See application file for complete search history.

(56) References Cited

U.S. PATENT DOCUMENTS

| | | | | |
|---|---|---|---|---|
| 9,119,270 | B2 | 8/2015 | Chen et al. | |
| 2006/0109205 | A1* | 5/2006 | Deng | H05B 33/0815 345/46 |
| 2007/0211463 | A1* | 9/2007 | Chevalier | H05B 33/0803 362/249.01 |
| 2007/0257623 | A1* | 11/2007 | Johnson | H05B 45/37 315/193 |
| 2009/0284172 | A1* | 11/2009 | Maschietto | H05B 45/24 315/294 |
| 2010/0134018 | A1* | 6/2010 | Tziony | H05B 45/37 315/122 |

(Continued)

OTHER PUBLICATIONS

S. Surikov, International Search Report and Written Opinion issued in application No. PCT/US2018/015322, completion date Apr. 12, 2018, dated Apr. 26, 2018, 8 pages, Federal Institute of Industrial Property, Moscow, Russia.

*Primary Examiner* — Daniel J Cavallari
*Assistant Examiner* — Brian K Baxter
(74) *Attorney, Agent, or Firm* — Pearne & Gordon LLP

(57) ABSTRACT

A device can include multiple light loads, where each light load includes at least one light source. The device can also include multiple switches coupled to the light loads. The device can further include a controller coupled to the switches, where the controller actively operates the switches multiple times within each cycle to control delivery of power to the light loads. Active operation of the switches by the controller is performed on a dynamic schedule, where the dynamic schedule is based on multiple environmental conditions, and where the controller bypasses a forward voltage of the light loads when actively operating the switches.

20 Claims, 19 Drawing Sheets

(56) References Cited

U.S. PATENT DOCUMENTS

2010/0176733 A1* 7/2010 King ..... H05B 37/0245 315/158
2011/0095704 A1 4/2011 Moussakov et al.
2011/0248640 A1* 10/2011 Welten ..... H05B 45/10 315/210
2012/0001566 A1* 1/2012 Josefowicz ..... H05B 33/0851 315/291
2012/0262093 A1* 10/2012 Recker ..... H05B 33/0854 315/308
2012/0293082 A1 11/2012 Huang et al.
2012/0299490 A1 11/2012 Lee et al.
2012/0306377 A1* 12/2012 Igaki ..... F21V 23/0464 315/151
2013/0328529 A1* 12/2013 Zbrozek ..... H02J 7/0016 320/118
2014/0015421 A1* 1/2014 Mituyasu ..... H05B 33/08 315/158
2014/0097761 A1* 4/2014 Chen ..... H05B 33/0893 315/192
2014/0111091 A1* 4/2014 Grajcar ..... H05B 45/48 315/122
2014/0210351 A1* 7/2014 Yu ..... H05B 45/48 315/122
2014/0361696 A1* 12/2014 Siessegger ..... H01L 27/156 315/186
2014/0375206 A1 12/2014 Holland et al.
2015/0198290 A1* 7/2015 Segers ..... H05B 33/0809 315/191
2015/0257225 A1* 9/2015 Yu ..... H05B 45/48 315/122
2015/0333512 A1* 11/2015 Saussele ..... H02S 10/20 700/287
2016/0174310 A1* 6/2016 Welten ..... H05B 45/3575 315/210
2016/0192455 A1* 6/2016 Dubuc ..... H05B 33/08 315/86
2018/0042075 A1* 2/2018 Welten ..... H05B 45/20

* cited by examiner

POWER REGULATION FOR LIGHTING FIXTURES

CROSS-REFERENCE TO RELATED APPLICATIONS

This application claims priority under 35 U.S.C. § 119 to U.S. Provisional Patent Application Ser. No. 62/450,168, titled "Power Regulation For Lighting Fixtures" and filed on Jan. 25, 2017, the entire contents of which are hereby incorporated herein by reference.

TECHNICAL FIELD

The present disclosure relates generally to lighting fixtures, and more particularly to power regulation of light-emitting diode (LED) lighting fixtures using LEDs as the light source.

BACKGROUND

The use of lighting fixtures with LEDs is becoming more common. However, the technology with respect to LEDs is evolving. While LED lighting fixtures are generally more energy efficient than lighting fixtures using other types of light sources (e.g., incandescent or fluorescent), there are a number of improvements that can be made to make LED lighting fixtures a more appealing alternative.

SUMMARY

In general, in one aspect, the disclosure relates to a device that includes multiple light loads, where each light load includes at least one light source. The device can also include multiple switches coupled to the light loads. The device can further include a controller coupled to the switches, where the controller actively operates the switches multiple times within each cycle to control delivery of power to the light loads. Active operation of the switches by the controller is performed on a dynamic schedule, where the dynamic schedule is based on multiple environmental conditions, and where the controller bypasses a forward voltage of the light loads when actively operating the switches.

In another aspect, the disclosure can generally relate to a method for dynamically regulating power for a lighting system. The method can include receiving multiple environmental conditions measured by multiple sensors. The method can also include operating, at a first time within a cycle, at least one first switch based on the environmental conditions, where operating the at least one first switch allows a first current to flow through a first subset of light loads and prevents the first current from flowing through a first remainder of light loads, where the first remainder of light loads receives power from a first remainder of energy storage devices.

These and other aspects, objects, features, and embodiments will be apparent from the following description and the appended claims.

BRIEF DESCRIPTION OF THE DRAWINGS

The drawings illustrate only example embodiments of power regulation for light fixtures and are therefore not to be considered limiting of its scope, as power regulation for light fixtures may admit to other equally effective embodiments. The elements and features shown in the drawings are not necessarily to scale, emphasis instead being placed upon clearly illustrating the principles of the example embodiments. Additionally, certain dimensions or positionings may be exaggerated to help visually convey such principles. In the drawings, reference numerals designate like or corresponding, but not necessarily identical, elements.

DETAILED DESCRIPTION OF EXAMPLE EMBODIMENTS

Figure 1:
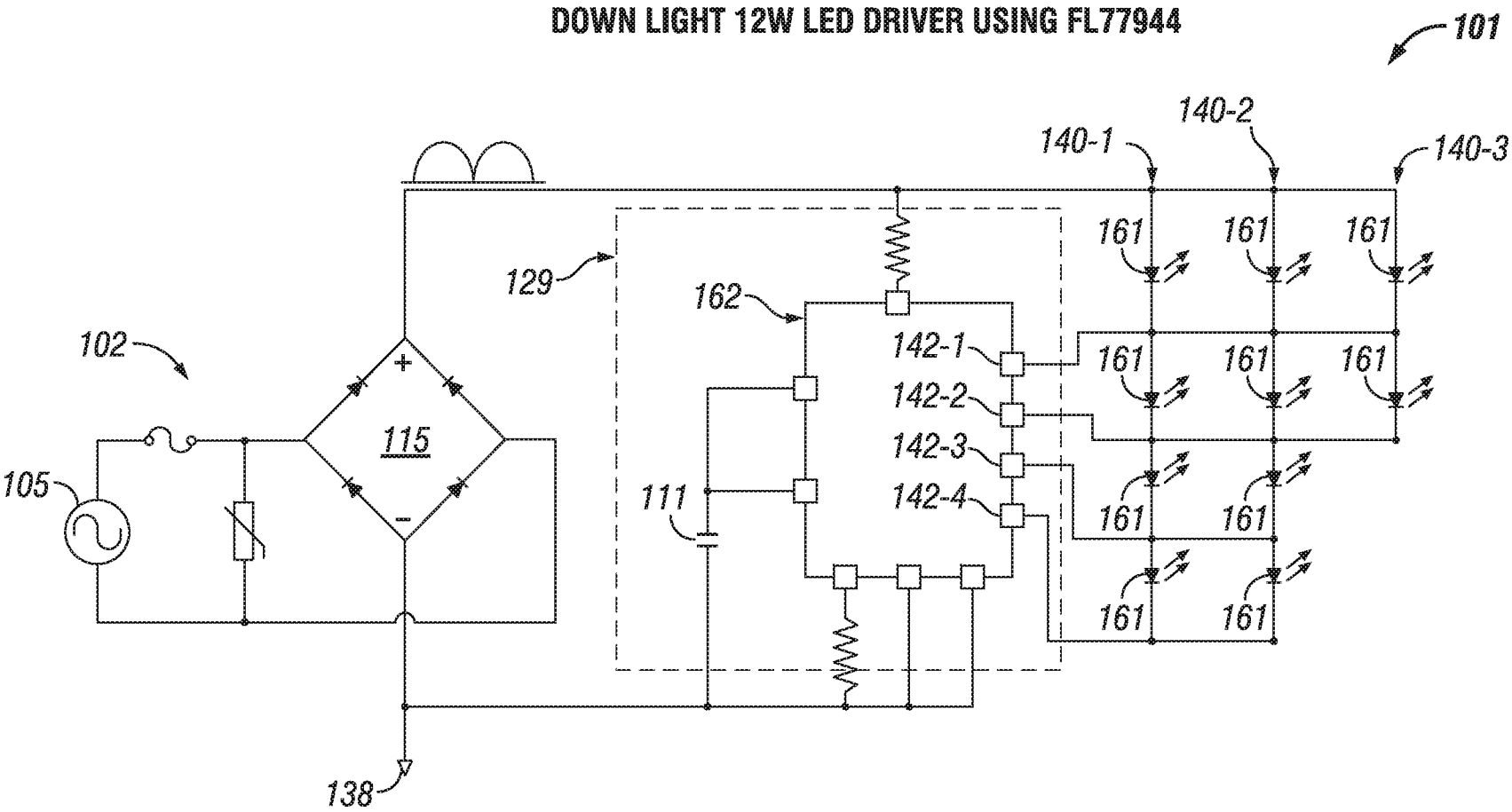
FIG. 1 (Prior Art)
FIG. 1 shows a circuit diagram of a light fixture currently known in the art.

The example embodiments discussed herein are directed to systems, methods, and devices for regulating power for light fixtures. In some cases, example embodiments may be used with one or more of a number of electrical devices that include a light source but that are not light fixtures. For example, example embodiments can be used with thermostats, control panels, exit signs, smoke detectors, a security panel, a surge protector, a fire protection panel, a breaker panel, and a light switch. Further, assets that can be controlled using example embodiments can include any of a number of devices (e.g., a badge, a cell phone, a personal digital assistant (PDA), a digital camera) that are attached, coupled to, or otherwise associated with an asset (e.g., a person, a vehicle, a piece of equipment).

The LED lighting circuits described herein may include one or more of a number of different types of LED technology. For example, each LED lighting circuit may be packaged or fabricated on a printed circuit board and/or with chip-on-board technology. Further, the number of LEDs used in various embodiments may be more or fewer than the number of LEDs in the example embodiments described herein. The number of LEDs used may depend on one or more of a number of factors including, but not limited to, the voltage drops of the LEDs selected and the voltage levels of the power source voltages used (e.g., 120 VAC, 240 VAC, 277 VAC). One or more example embodiments may be used with a LED lighting circuit that is dimmable.

Devices being regulated by example embodiments can use one or more of a number of different types of light sources, including but not limited to light-emitting diode (LED) light sources, fluorescent light sources, organic LED light sources, incandescent light sources, and halogen light sources. Therefore, devices used with example embodiments described herein should not be considered limited to using a particular type of light source. The devices (or components thereof, including controllers) capable of being regulated by example embodiments described herein can be made of one or more of a number of suitable materials. Examples of such materials can include, but are not limited to, aluminum, stainless steel, fiberglass, glass, plastic, ceramic, and rubber.

In the foregoing figures showing example embodiments of regulating power for light fixtures in a lighting system, one or more of the components shown may be omitted, repeated, and/or substituted. Accordingly, example embodiments of regulating power for light fixtures in a lighting system should not be considered limited to the specific arrangements of components shown in any of the figures. For example, features shown in one or more figures or described with respect to one embodiment can be applied to another embodiment associated with a different figure or description.

In certain example embodiments, light fixtures (or other devices being controlled by example embodiments) are subject to meeting certain standards and/or requirements. For example, the National Electric Code (NEC), the National Electrical Manufacturers Association (NEMA), the International Electrotechnical Commission (IEC), the Federal Communication Commission (FCC), the Illuminating Engineering Society (IES), and the Institute of Electrical and Electronics Engineers (IEEE) set standards as to electrical enclosures, wiring, and electrical connections. Use of example embodiments described herein meet (and/or allow a corresponding device to meet) such standards when required. In some (e.g., PV solar) applications, additional standards particular to that application may be met by the devices described herein.

If a component of a figure is described but not expressly shown or labeled in that figure, the label used for a corresponding component in another figure can be inferred to that component. Conversely, if a component in a figure is labeled but not described, the description for such component can be substantially the same as the description for the corresponding component in another figure. The numbering scheme for the various components in the figures herein is such that each component is a three or four digit number and corresponding components in other figures have the identical last two digits.

Further, a statement that a particular embodiment (e.g., as shown in a figure herein) does not have a particular feature or component does not mean, unless expressly stated, that such embodiment is not capable of having such feature or component. For example, for purposes of present or future claims herein, a feature or component that is described as not being included in an example embodiment shown in one or more particular drawings is capable of being included in one or more claims that correspond to such one or more particular drawings herein.

Example embodiments of regulating power for light fixtures in a lighting system will be described more fully hereinafter with reference to the accompanying drawings, in which example embodiments of regulating power for light fixtures in a lighting system are shown. Regulating power for light fixtures in a lighting system may, however, be embodied in many different forms and should not be construed as limited to the example embodiments set forth herein. Rather, these example embodiments are provided so that this disclosure will be thorough and complete, and will fully convey the scope of regulating power for light fixtures in a lighting system to those of ordinary skill in the art. Like, but not necessarily the same, elements (also sometimes called components) in the various figures are denoted by like reference numerals for consistency.

Terms such as "first", "second", and "within" are used merely to distinguish one component (or part of a component or state of a component) from another. Such terms are not meant to denote a preference or a particular orientation, and are not meant to limit embodiments of regulating power for light fixtures in a lighting system. In the following detailed description of the example embodiments, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

FIG. 1 shows a circuit diagram 100 of a light fixture 101 currently known in the art. Specifically, FIG. 1 shows an AC powered LED lighting circuit. The circuit diagram 100 includes a LED driver circuit 129, a power supply 102, and three light loads 140 (light load 140-1, light load 140-2, and light load 140-3). Each light load 140 includes one or more light sources 161. In this case, each light source 161 is a LED. Light load 140-1 has four light sources 161, light load 140-2 has four light sources 161, and light load 140-3 has two light sources 161.

The power supply 102 provides power to the remainder of the circuit 100, which in this case is the LED driver circuit 129 and the light loads 1540. The power supply 102 can include one or more of a number of components. For example, in this case, the power supply 102 includes an alternating current (AC) source 105, a fuse, a metal-oxide varistor (MOV), and a rectifier 115. The AC source 105 provides AC power to the LED driver circuit 129 and the array of series-connected current-regulated light loads 140. The AC source 105 may generate any input voltage and/or current to the light fixture 101 suitable to operate the LED lighting circuit 100. For example, the AC source 105 may be a 120 $V_{rms}$ (root-mean-square) source commonly found in residential and commercial buildings. As another example, the AC source 105 may be a 24 $V_{rms}$ source obtained through a transformer that converts voltage and provides isolation. As yet another, the AC source 105 may deliver 480 VAC input power to the light fixture 101.

The rectifier 115 is disposed between the AC source 105 and the LED driver circuit 129 and the single array of series-connected current-regulated light loads 140. In one or more example embodiments, the rectifier 115 is configured to convert the power received from the AC source 105 into a form of power used by the LED driver circuit 129 and, in some cases, the single array of series-connected current-regulated light loads 140. For example, the rectifier 115 may be a full wave rectifier 115 that converts the sinusoidal AC from the AC source 105 to a rectified AC supply or direct current ("DC") supply having a constant polarity. The rectifier 115 may be a configuration of multiple diodes (as shown in FIG. 1), a semiconductor, or any other suitable component or set of components. The rectifier 115 of FIG. 1 is known as a full-wave rectifier. In this example, the rectifier 115 converts a 120 $V_{rms}$ alternating current (VAC) power supply 102 into positive voltages.

In one or more example embodiments, the single array of series-connected light loads 140 (or simply light loads 140), shown in FIG. 1, are connected in series. An array of series-connected LEDs may be one or more light sources 161 connected in series so that a current flows through all light sources 161 in the array. In certain example embodiments, the light loads 140 receive a sinusoidal voltage from the rectifier 115. When the voltage across a light load exceeds the sum of the forward voltages of the light sources 161 in that light load 140, the light sources 161 will conduct current (i.e., the light sources 161 in the light load 140 will turn on). As the voltage increases, the current through the light sources 161 in the light load 140 also increases.

The LED driver circuit 129 of FIG. 1 uses the power delivered by the power supply 102 to control the amount of current that flows through each light load 140. With LED driver circuits 129 currently known in the art, a LED driver circuit 129 sends and cuts off current to each light load 140 on a pre-determined schedule. The LED driver circuit 129 can include one or more of a number of components. For example, in this case, the LED driver circuit 129 can include an integrated circuit 162 (IC 162), a capacitor 111, and two resistors. Examples of other components can include, but are not limited to, a diode, an inductor, and a transistor. The LED driver circuit 129 includes one or more (in this case, four) switches 142, which can be incorporated into the IC 162 (as in this case) and/or a discrete component (e.g., a transistor). One or more of the switches 142 can be part of, or separate from, the LED driver circuit 129. The LED driver circuit 129 in this case is a direct drive architecture, where the LED driver circuit 129 provides direct control of the light loads 140.

Figure 2:
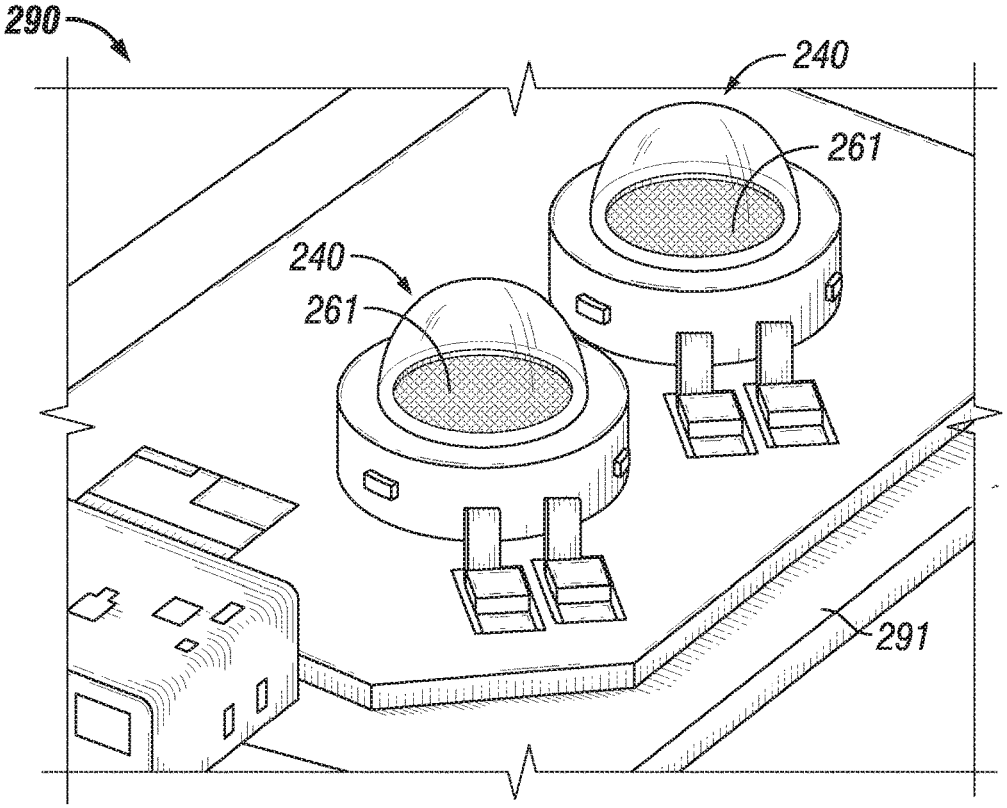
FIG. 2 (Prior Art)
FIGS. 2 and 3 show circuit board assemblies for light fixtures currently known in the art.
Figure 3:
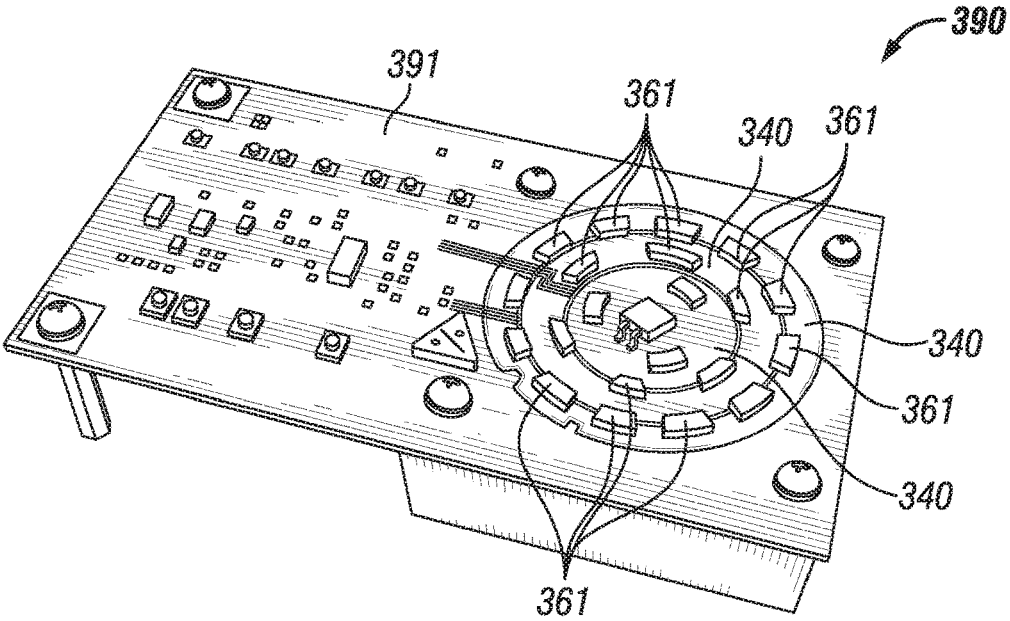
FIG. 3 (Prior Art)

FIGS. 2 and 3 show circuit board assemblies for light fixtures currently known in the art. Referring to FIGS. 1-3, the circuit board assembly 290 of FIG. 2 includes a small number (in this case, two) of light loads 240 mounted on a circuit board 291, where each light load 240 includes a single light source 269. Also mounted on the circuit board 291, but hidden from view, is a LED driver circuit. The circuit board assembly 390 of FIG. 3 includes a small number (in this case, 3) of light loads 340 mounted on a circuit board 391 as concentric circles. Light load 340-1 has 12 light sources 361, light load 340-2 has 6 light sources 361, and light load 340-3 has 3 light sources 361. Also mounted on the opposite side (and so hidden from view) of the circuit board 391 from the light loads 340 is a LED driver circuit.

Figure 4:
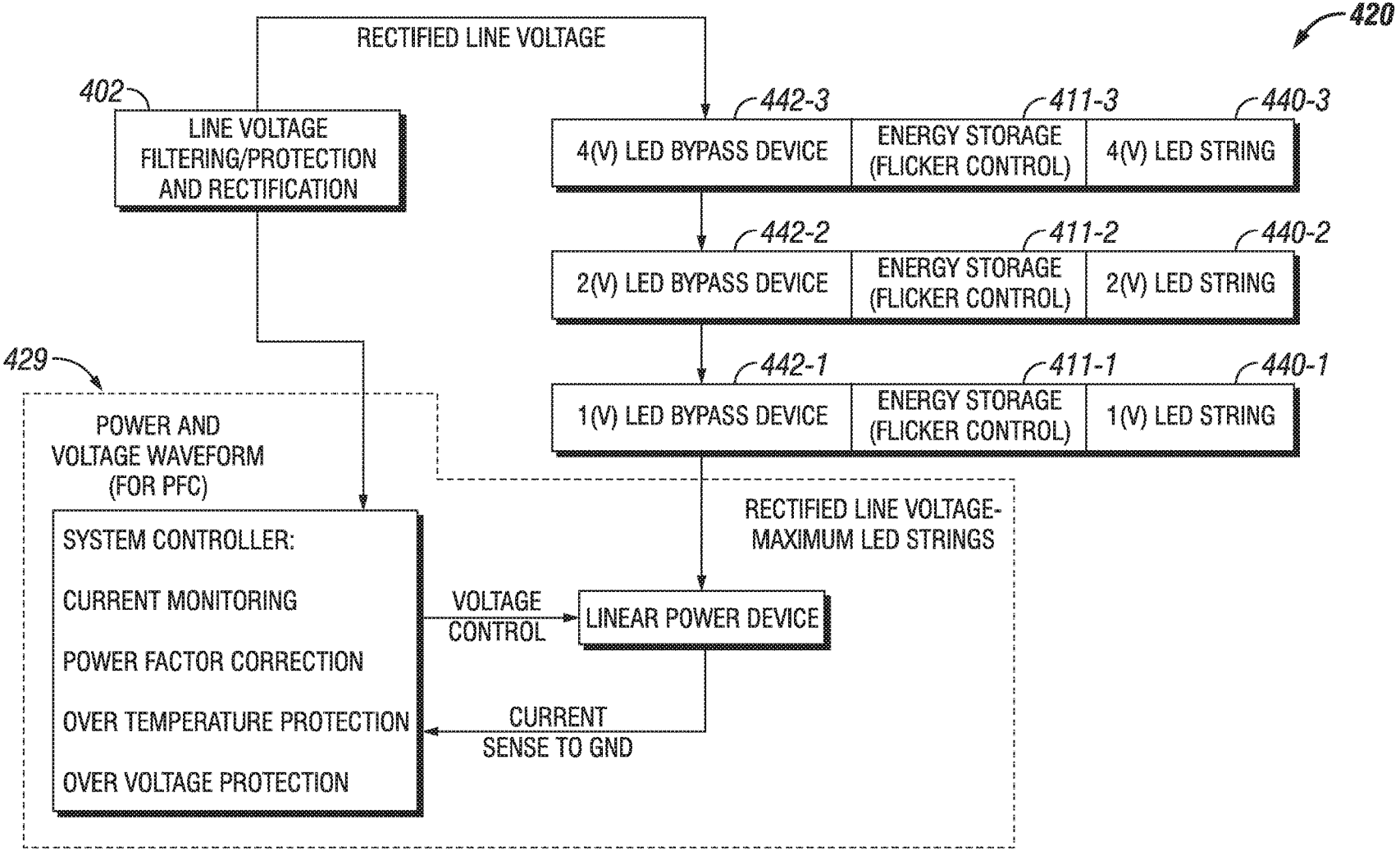
FIG. 4 (Prior Art)
FIG. 4 shows a block diagram of a light fixture currently known in the art.

FIG. 4 shows a block diagram 470 of a light fixture currently known in the art. Referring to FIGS. 1-4, the block diagram 470 includes a power supply 402, which provides rectified line voltage to the three light loads 440 (light load 440-1, light load 440-2, and light load 440-3) and to the LED driver circuit 429. The LED driver circuit 429 is substantially similar to the LED driver circuit 129 described above with respect to FIG. 1 and can act as a type of system controller that performs such functions as current monitoring, power factor correction, over-temperature protection, and over-voltage protection. The LED driver circuit 429 can also include a linear power device for providing voltage control. As can be seen from the direction of the arrows shown in FIG. 4, there is no control by the LED driver circuit 429 on the operation of the light loads 440.

Each of the three light loads 440 can have a finite number of light sources (e.g., light sources 161). The block diagram 470 also includes a number of energy storage devices 411 (e.g., capacitor 111) (in this case, energy storage device 411-1, energy storage device 411-2, and energy storage device 411-3) and a number of switches 442 (e.g., a field-effect transistors (FETs)) (in this case, switch 442-1, switch 442-2, and switch 442-3). In this case, there is one energy storage device 411 and one switch 442 for each light load 440. The energy storage device 411 is used to help reduce flickering that results from turning a light load 440 on and off. The energy storage device 411 stores power when the corresponding switch 442 is closed, thereby allowing the power to flow to the light load 440. When the corresponding switch 442 is open, thereby preventing power from flowing to the light load 440 and the energy storage device 411, the voltage stored by the energy storage device 411 is released to the light load 440.

Figure 5:
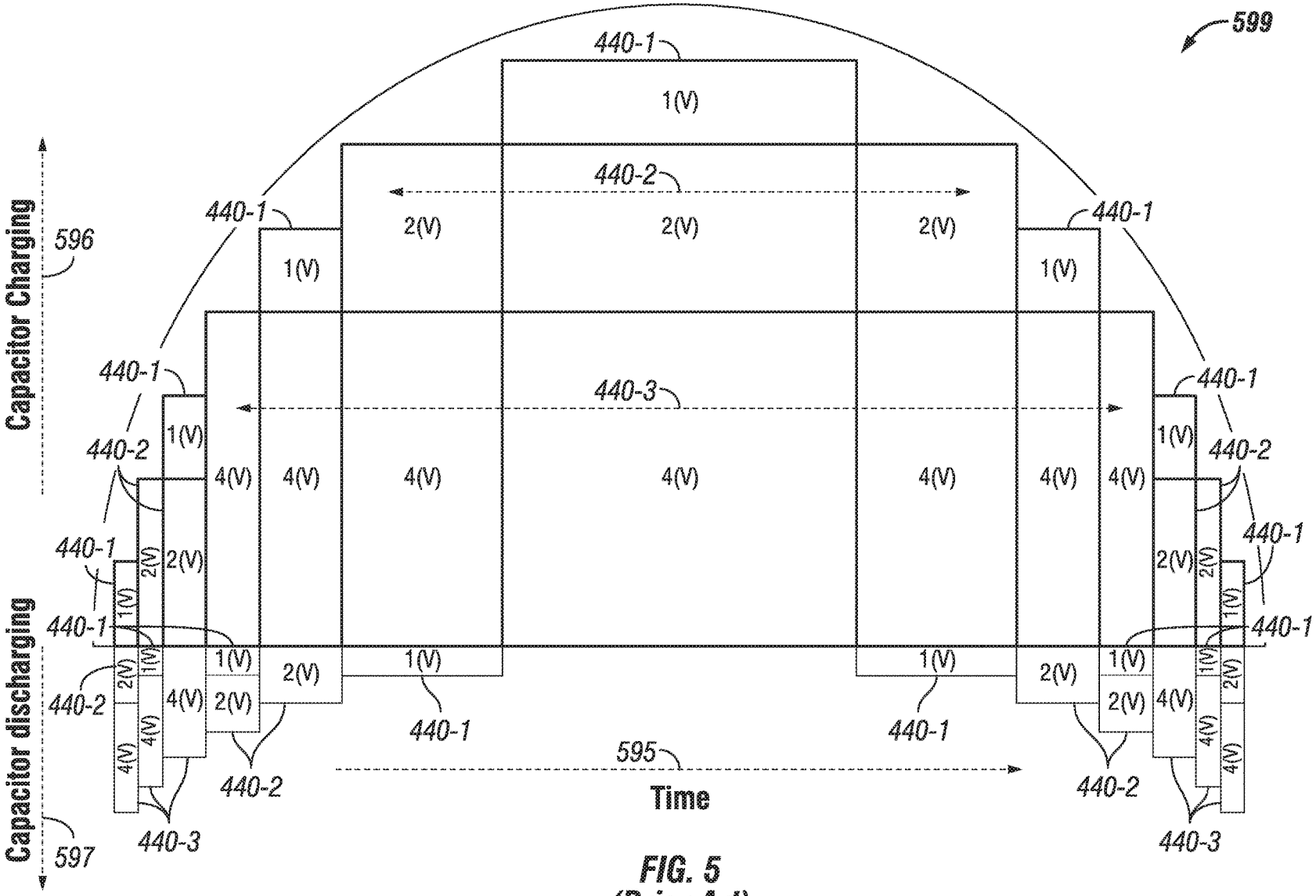
FIG. 5 (Prior Art)
FIG. 5 shows a distribution plot of light sources for a light fixture currently known in the art.

As discussed above, the switches 442 in lighting circuits in the current art operate on a fixed schedule. An example of this is shown in FIG. 5. Specifically, FIG. 5 shows a distribution plot 599 of light sources for a light fixture currently known in the art. Referring to FIGS. 1-5, the distribution plot 599 shows how the various light loads 440 of FIG. 4 are turned on and off over time 595 (in this case, one half of a cycle). In this case, there are 13 intervals of time 595 within the cycle in the distribution plot 599. One interval can be of the same duration or a different duration compared to the duration of one or more of the other 12 intervals. As used herein, the term "cycle" refers to one oscillation (e.g., unrectified full cycle, rectified half cycle) of an alternating current waveform. The frequency (e.g., 50 Hz, 60 Hz, 100 Hz, 120 Hz, 10 kHz) of such an alternating current waveform can vary based on the characteristics of power provided in a particular area and/or on the equipment using the power.

During the initial interval, light load 440-1 receives power (switch 442-1 is closed) and the corresponding energy storage device 411-1 is charging 596. At the same time, switch 442-2 and switch 442-3 are open, and so energy storage device 411-2 and energy storage device 411-3 are discharging 597 to provide power to light load 440-2 and light load 440-3, respectively. During the second interval, light load 440-2 receives power (switch 442-2 is closed) and the corresponding energy storage device 411-2 is charging 596. At the same time, switch 442-1 and switch 442-3 are open, and so energy storage device 411-1 and energy storage device 411-3 are discharging 597 to provide power to light load 440-1 and light load 440-3, respectively.

During the third interval, light load 440-2 receives power (switch 442-2 is closed) and the corresponding energy storage device 411-2 is charging 596. Further, light load 440-1 receives power (switch 442-1 is closed) and the corresponding energy storage device 411-1 is charging 596. At the same time, switch 442-3 is open, and so energy storage device 411-3 is discharging 597 to provide power to light load 440-3. During the fourth interval, light load 440-3 receives power (switch 442-3 is closed) and the corresponding energy storage device 411-3 is charging 596. At the same time, switch 442-1 and switch 442-2 are open, and so energy storage device 411-1 and energy storage device 411-2 are discharging 597 to provide power to light load 440-1 and light load 440-2, respectively.

During the fifth interval, light load 440-1 receives power (switch 442-1 is closed) and the corresponding energy storage device 411-1 is charging 596. Further, light load 440-3 receives power (switch 442-3 is closed) and the corresponding energy storage device 411-3 is charging 596. At the same time, switch 442-2 is open, and so energy storage device 411-2 is discharging 597 to provide power to light load 440-2. During the sixth interval, light load 440-2 receives power (switch 442-2 is closed) and the corresponding energy storage device 411-2 is charging 596. Further, light load 440-3 receives power (switch 442-3 is closed) and the corresponding energy storage device 411-3 is charging 596. At the same time, switch 442-1 is open, and so energy storage device 411-1 is discharging 597 to provide power to light load 440-1.

During the seventh interval, all three switches 442 are closed, and so light load 440-1, light load 440-2, and light load 440-3 receive power, and energy storage device 411-1, energy storage device 411-2, and energy storage device 411-3 are charging 596. During the eighth interval, the configuration of the sixth interval is repeated. During the ninth interval, the configuration of the fifth interval is repeated. During the tenth interval, the configuration of the fourth interval is repeated. During the eleventh interval, the configuration of the third interval is repeated. During the twelfth interval, the configuration of the second interval is repeated. During the thirteenth interval, the configuration of the first interval is repeated.

Figure 6:
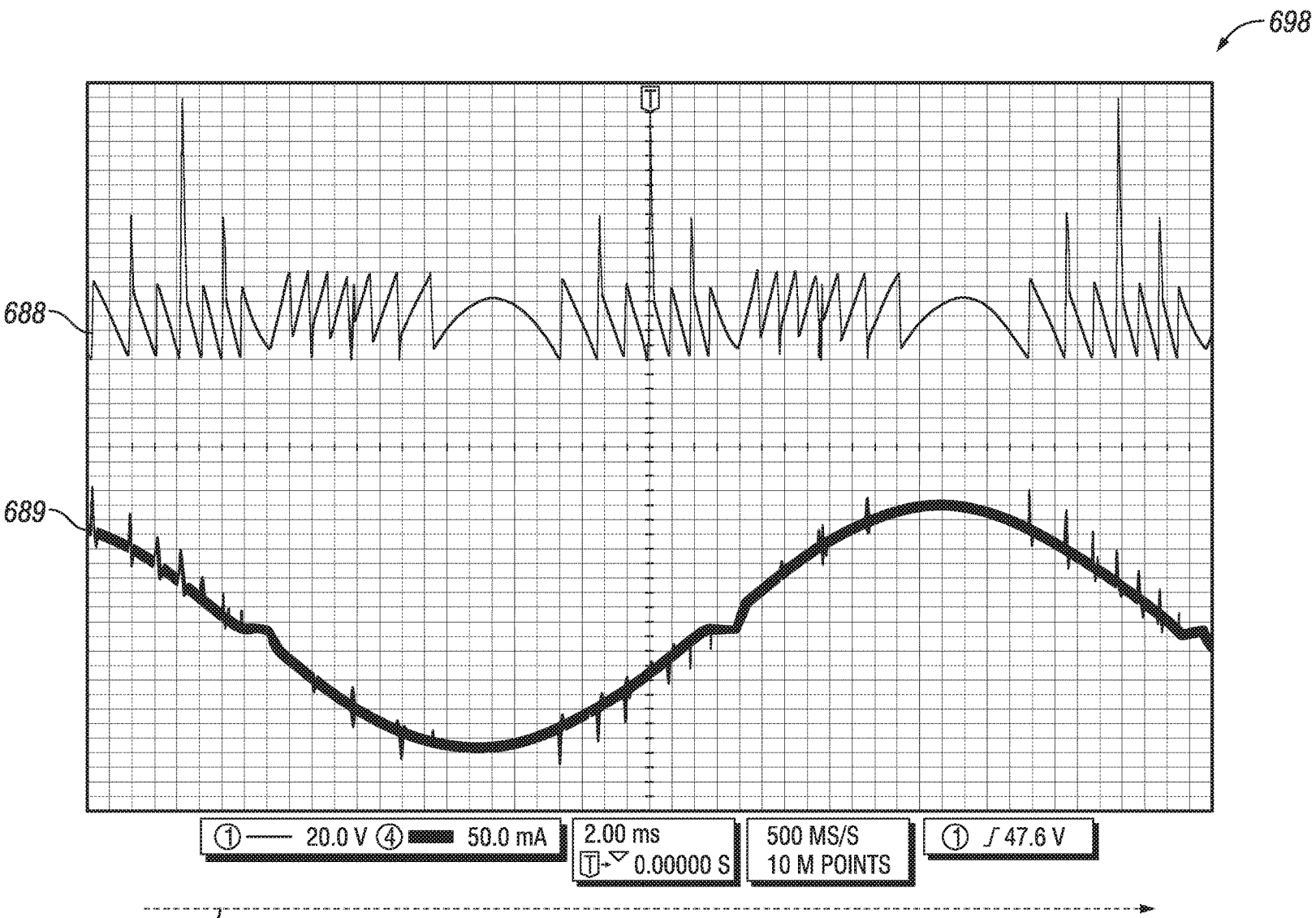
FIG. 6 (Prior Art)
FIG. 6 shows a plot of current and voltage for a light fixture currently known in the art.

FIG. 6 shows a plot 698 of current 689 and voltage 688 over time 695 for a light fixture currently known in the art. Referring to FIGS. 1-6, the current 689 is nearly sinusoidal, which means that the power factor (PF) is extremely high (e.g., PF ~0.995). For currently-existing standards, the minimum requirement for PF is 0.9. Therefore, the pre-determined switching in current light fixtures results in a PF that greatly exceeds the minimum requirement. A consequence of this nearly perfect PF is excessive heat that builds in the switches 442 as a result of receiving voltage.

As stated above, a switch (e.g., switch 442-1) is often a FET. In such a case, the FET runs in linear mode to act as a current control device for one or more light loads. The voltage 688 shown in the plot 698 is drain voltage of a FET. The FET is controlled to maintain a specific current, and the FET closely matches the current to track the input line voltage. The FET consumes excess voltage present in the sine wave because there is a disconnect between the voltage in the sine wave and the desired voltage sent to a corresponding light load based on the forward voltage ($V_f$) of the light load and the current 689. When the PF is very high (approaching 1), as in the current art, the current 689 and voltage follow each other closely, which means that there is increased voltage across the FET.

This pre-determined pattern of operating switches (e.g., switches 442) in the current art does not take into consideration any changes (e.g., deteriorated performance of a light load, overheating of a switch) in the system. Further, embodiments used in the current art only operate in a limited range of input voltages. By contrast, example embodiments consider real-time operational data to determine when and how the various switches should be operated. In this way, example embodiments can be referred to as operating on a dynamic schedule that considers a number of environmental conditions and makes adjustments as one or more environmental conditions change. Further, example embodiments operate over a much wider range of input voltages.

Figure 7:
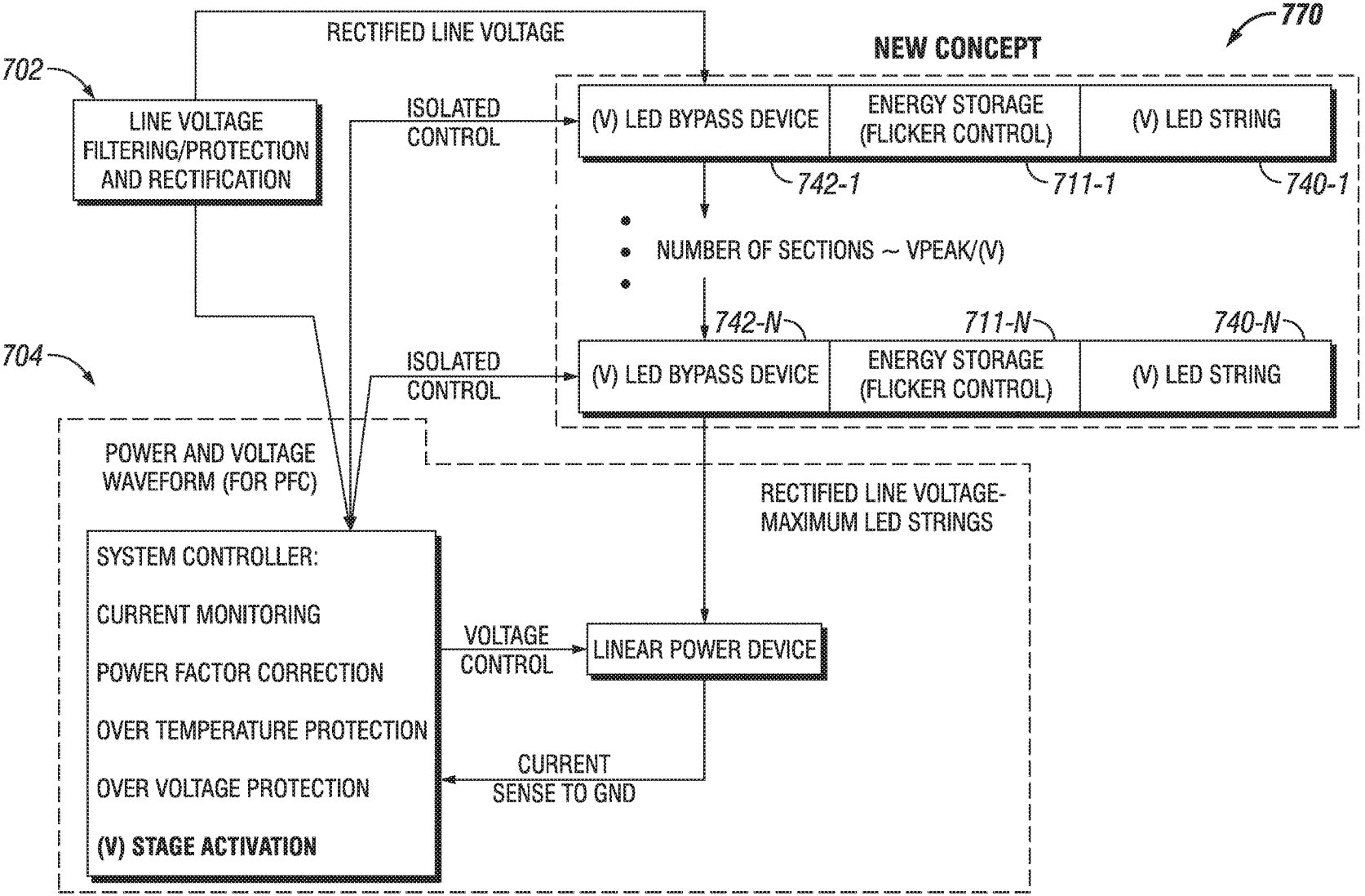
FIGS. 7 and 8 each show a block diagram of a light fixture in accordance with one or more example embodiments.
Figure 8:
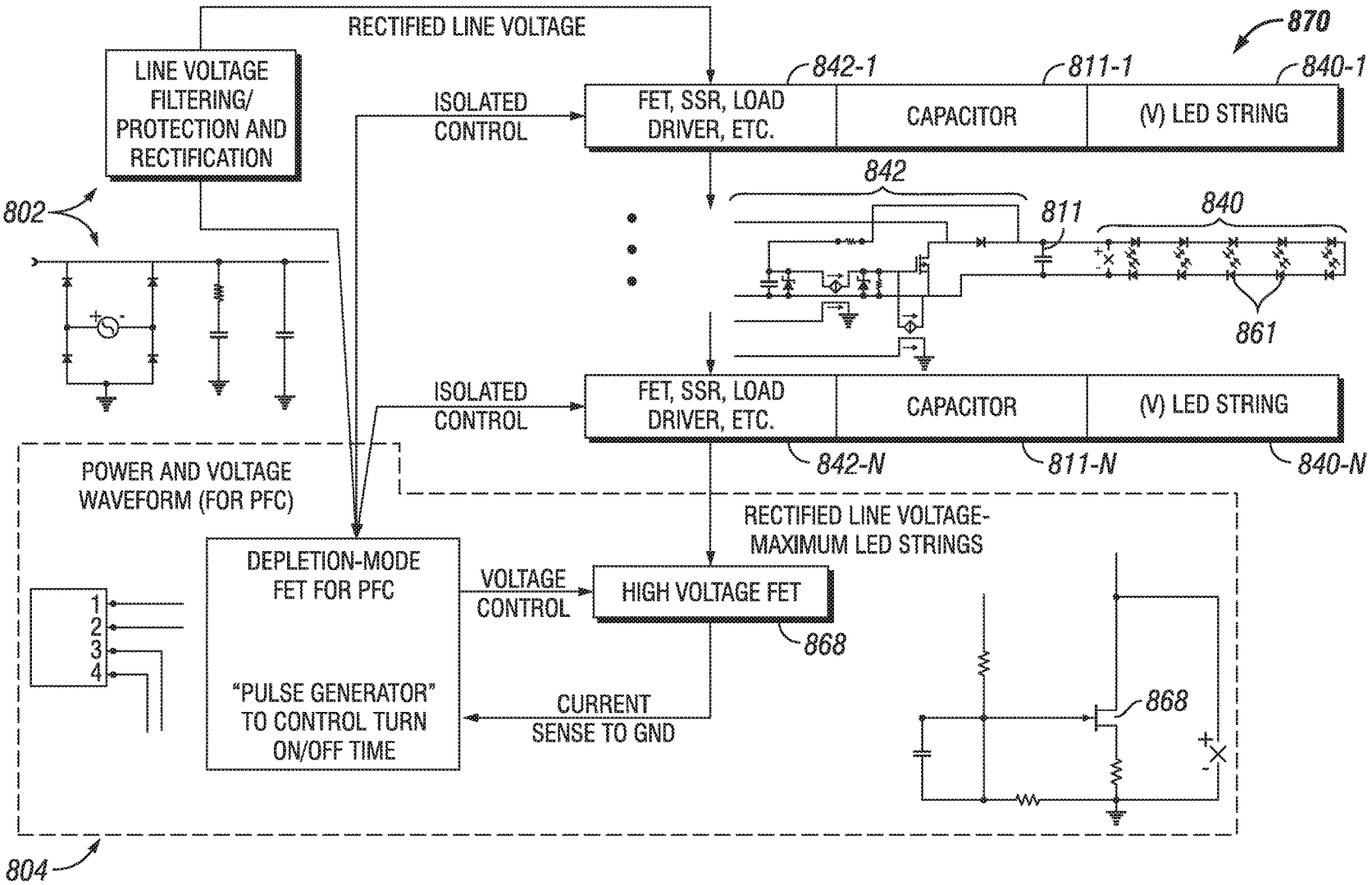

FIGS. 7 and 8 each show a block diagram of a light fixture in accordance with one or more example embodiments. Specifically, FIG. 7 shows a block diagram 770 of one example embodiments. FIG. 8 shows a block diagram 870, along with corresponding portions of circuit diagrams, of another example light fixture. Referring to FIGS. 1-8, the block diagram 70 of FIG. 7 is substantially the same as the block diagram 470 of FIG. 4, except as described below. For example, the LED driver circuit 429 of FIG. 4 is replaced by a controller 704 in FIG. 7. The controller 704 can perform all of the functions of the LED driver circuit 429 of FIG. 4, plus one or more additional functions. For example, the controller 704 can actively (dynamically) control one or more of the switches 742. This is evidenced by the addition of control arrows in FIG. 7 from the controller 704 to each of the switches 742.

As another example, there are a much larger number (e.g., 8, 17, 21) of light loads 740 (as well as corresponding switches 742 and energy storage devices 711) compared to the three light loads 440 (as well as corresponding switches 442 and energy storage devices 411) of FIG. 4. As a result of this configuration shown in the block diagram 770 of FIG. 7, example embodiments can operate over a much wider range of input voltages, as provided by the power supply 702. While the total forward voltages of the light loads 740 approach the maximum line voltage, the light sources of the light loads 740 can be illuminated at all times using example embodiments.

Specifically, the controller 704 can actively (dynamically) add and/or remove light loads 740 on a real-time basis by bypassing the forward voltage of the light loads 740. By allowing the switches 742 (and so also the corresponding light loads 740) to be configured in real time, the controller 704 can develop one or more algorithms to maintain substantially constant light output while increasing efficiency and extending the useful life of the various components (e.g., switches 742, light loads 740) of a light fixture. For example, the controller 704 can enhance reliability of a light fixture by preventing the use one or more light loads 740 that have failed or are about to fail (e.g., shorted or open light source, damaged energy storage device 711).

The block diagram 870 of FIG. 8 is substantially the same as the block diagram 770 of FIG. 7, except as described below. For example, in the block diagram 870 of FIG. 8, a high voltage FET 868 is incorporated into the controller 804, although in other cases, the high voltage FET 868 (or other type of switch 868) can be a separate component that is coupled to the controller 804. The FET 868 in this case is placed in parallel with one or more of the light loads 840 (e.g., light load 840-1, light load 840-N), as well as the corresponding local switches 842 (e.g., switch 842-1, switch 842-N) and energy storage devices 811 (e.g., energy storage device 811-1, energy storage device 811-N). In this way, if the FET 868 is on (or, alternatively, if a switch 842 is closed), then the one or more light loads 840 in parallel with the FET 868 (or switch 842) are bypassed. Alternatively, if the FET 868 is off (or, alternatively, if a switch 842 is open), then current flows through the one or more light loads 840 in parallel with the FET 868 (or switch 842). In certain example embodiments, the FET 868 can replace one or more local switches 842 associated with light loads 840 connected in parallel with the FET 868. The voltage/current is provided to the light loads 840 by the power supply 802, and the switches 842 are dynamically operated by the example controller 804.

Figure 9:
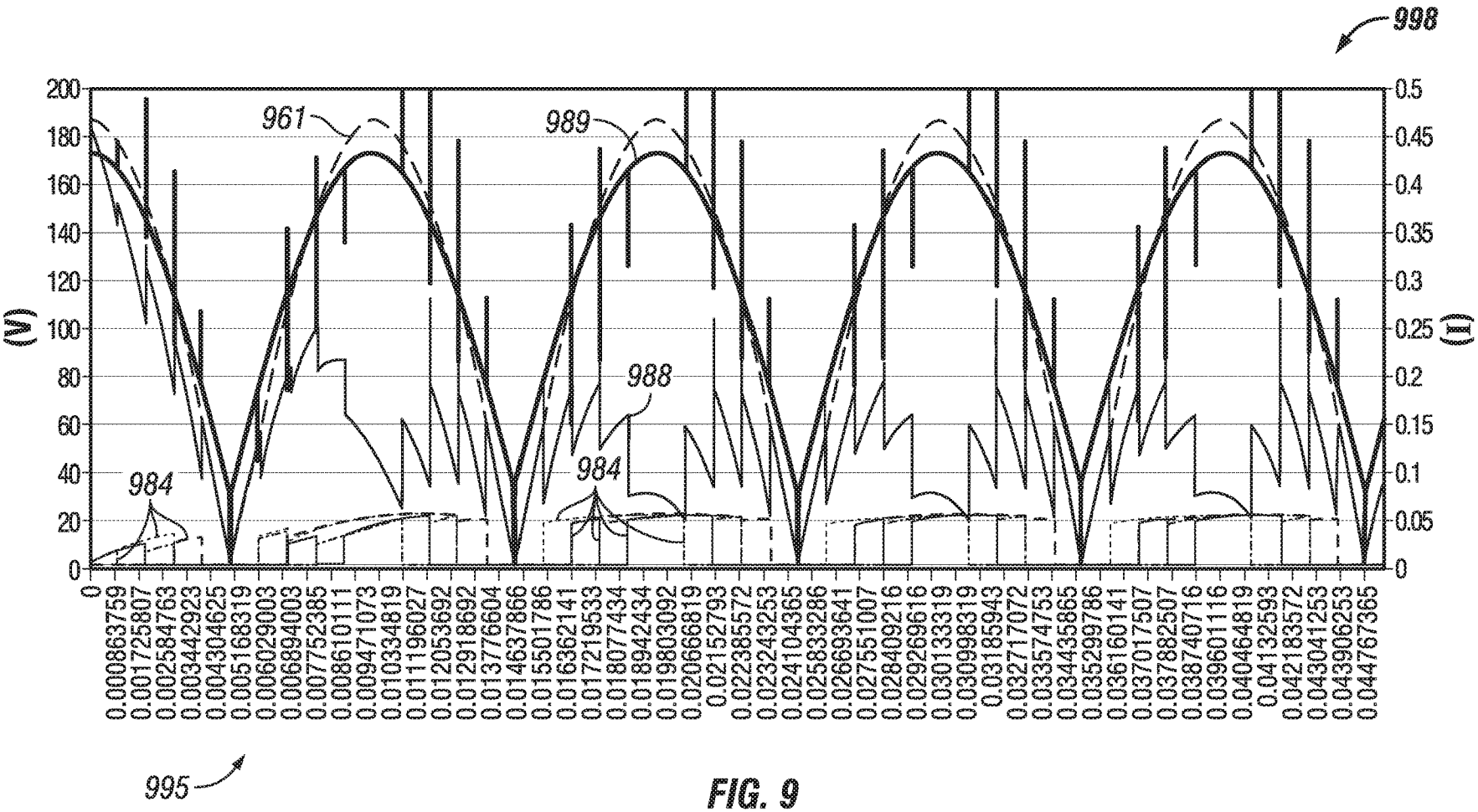
FIG. 9 shows a plot of current and voltage for a light fixture in accordance with one or more example embodiments.

FIG. 9 shows a plot 988 of current and voltage for a light fixture in accordance with one or more example embodiments. Referring to FIGS. 1-9, the plot 988 shows the line voltage 961, the current 989, the drain voltage 988 of the FET (e.g., FET 868), and the current 984 flowing through 16 different light loads over time 995. Using example embodiments, the drain voltage 988 of the FET is more erratic than the drain voltage 688 of the FET shown in FIG. 6, resulting in less heat generated by the FET. Further, because the line voltage 961 and the current 989 do not follow each other as closely as they do using currently-known circuits, the power factor is lower, but still within acceptable values (e.g., PF is at least 0.9).

Figure 10:
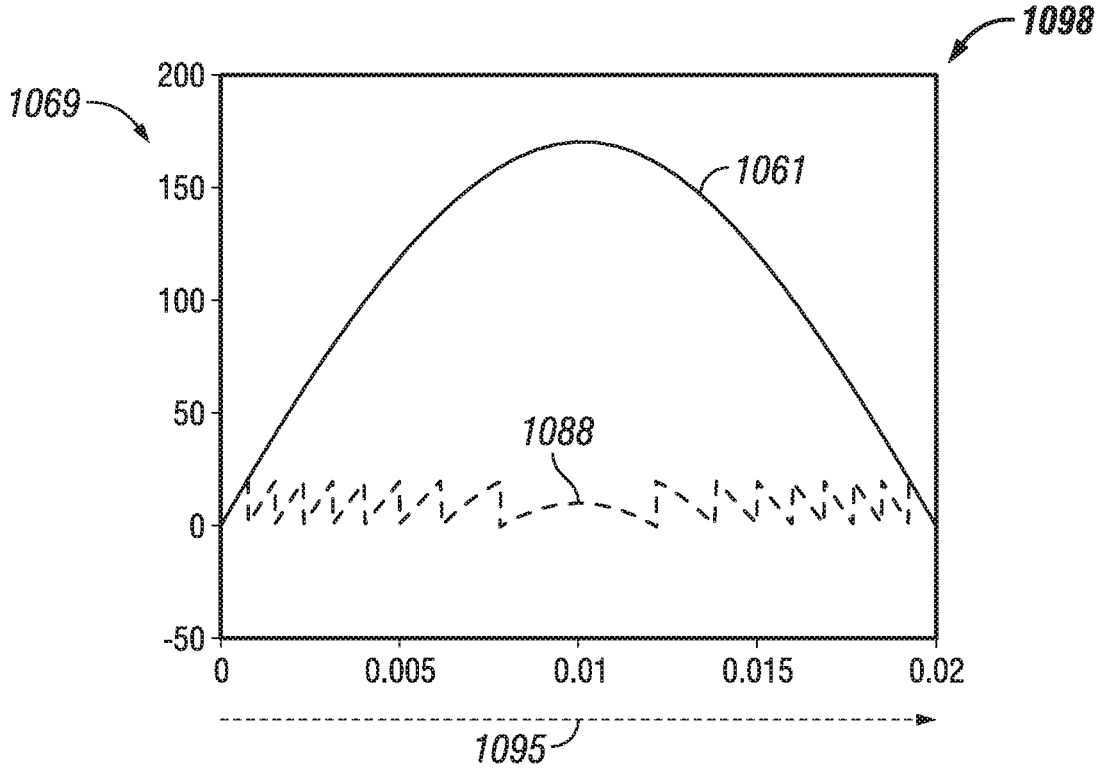
FIGS. 10-12 show a plot of voltage for a light fixture in accordance with one or more example embodiments.
Figure 11:
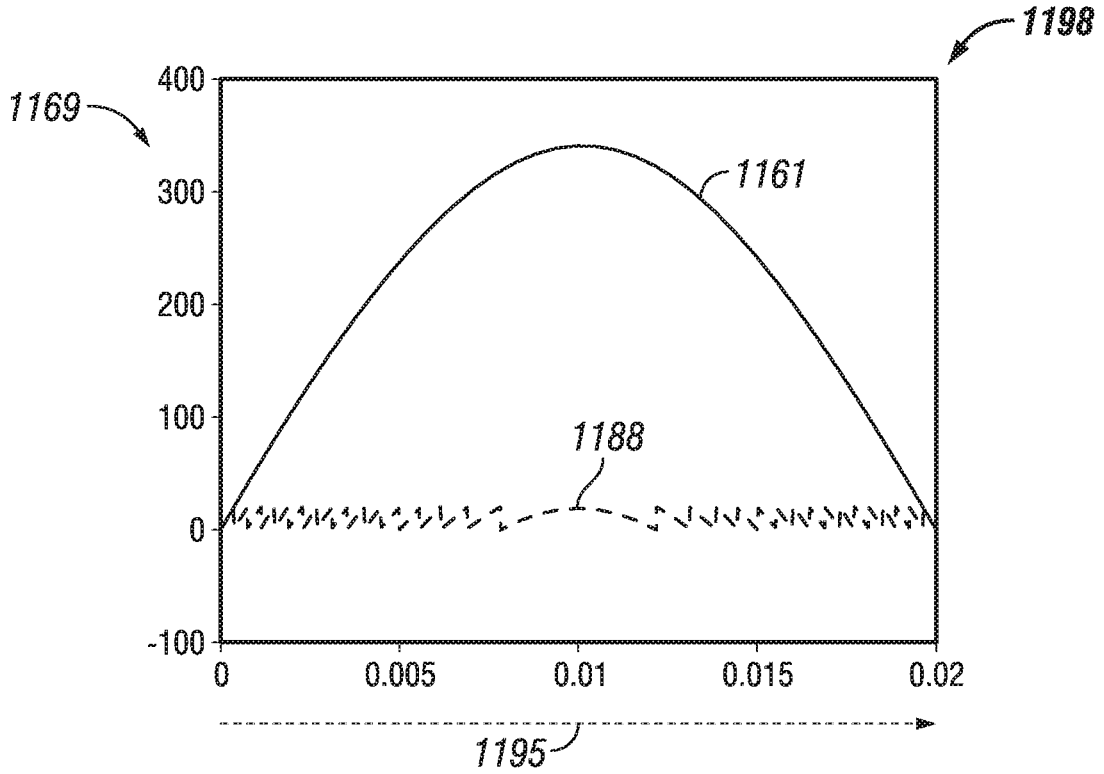
Figure 12:
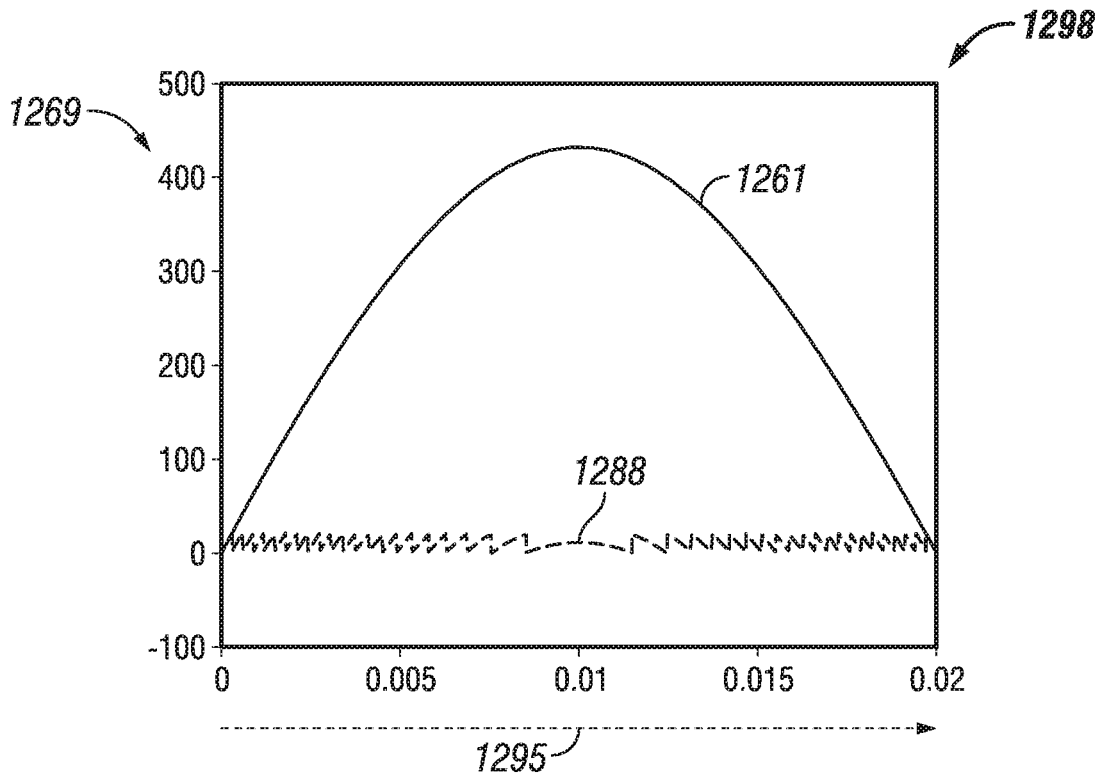

FIGS. 10-12 each shows a plot of voltage for a light fixture in accordance with one or more example embodiments. Specifically, FIG. 10 shows a plot 1098 of voltage 1069 over time 1095. FIG. 11 shows a plot 1198 of voltage 1169 over time 1195. FIG. 12 shows a plot 1298 of voltage 1269 over time 1295. Referring to FIGS. 1-12, the plot 1098 of FIG. 10 shows the line voltage 1061 and the drain voltage 1088 of the FET (e.g., FET 868) or other switch. In this case, there are 8 line loads (and so also 8 switches), and this arrangement can operate between 120 VAC and 177 VAC.

The plot 1198 of FIG. 11 shows the line voltage 1161 and the drain voltage 1188 of the FET (e.g., FET 868) or other switch. In this case, there are 17 line loads (and so also 17 switches), and this arrangement can operate between 240 VAC and 350 VAC. The plot 1298 of FIG. 12 shows the line voltage 1261 and the drain voltage 1288 of the FET (e.g., FET 868) or other switch. In this case, there are 21 line loads (and so also 21 switches), and this arrangement can operate between 277 VAC and 440 VAC.

Figure 13:
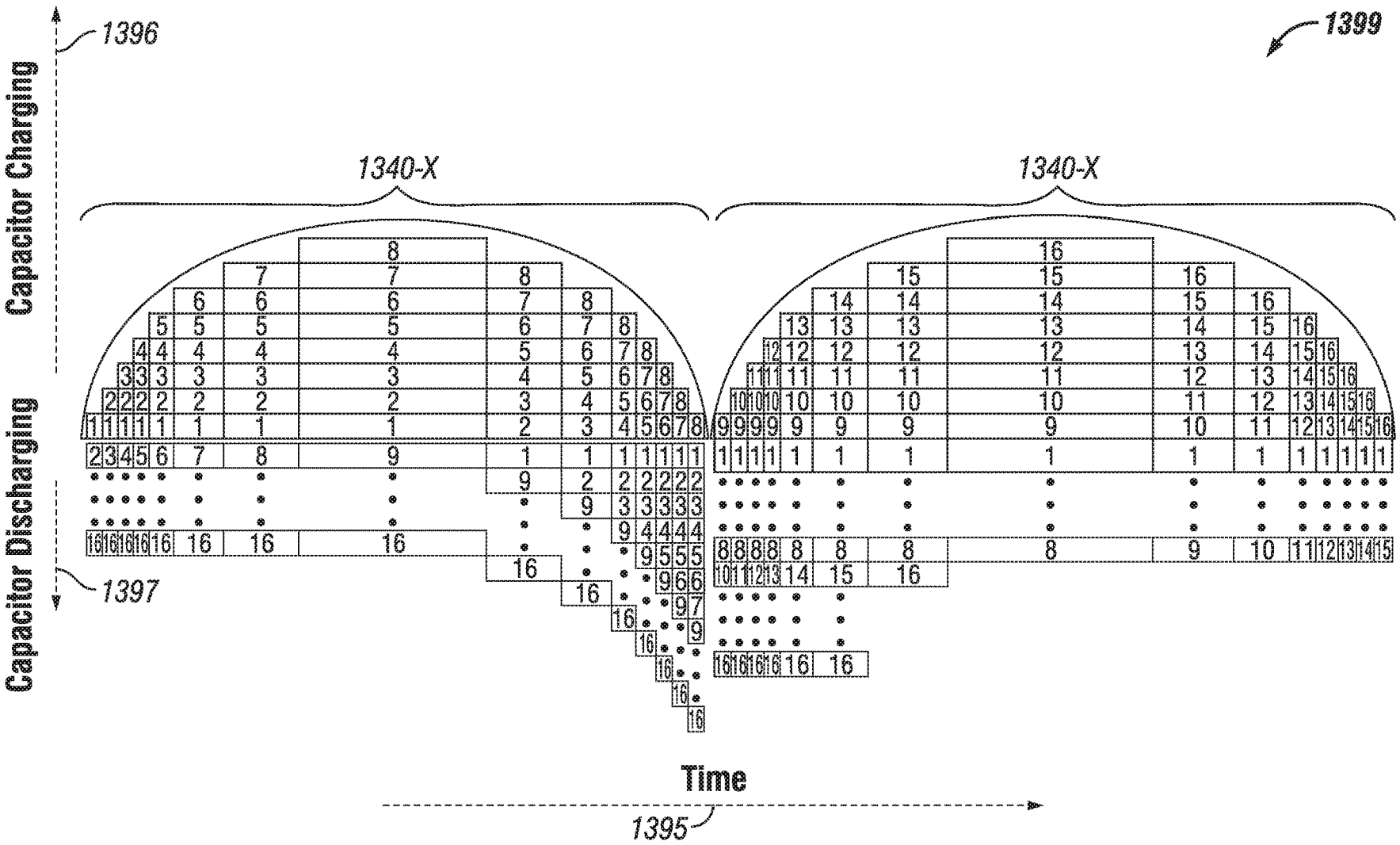
FIGS. 13 and 14 show a distribution plot of light sources for a light fixture in accordance with one or more example embodiments.
Figure 14:
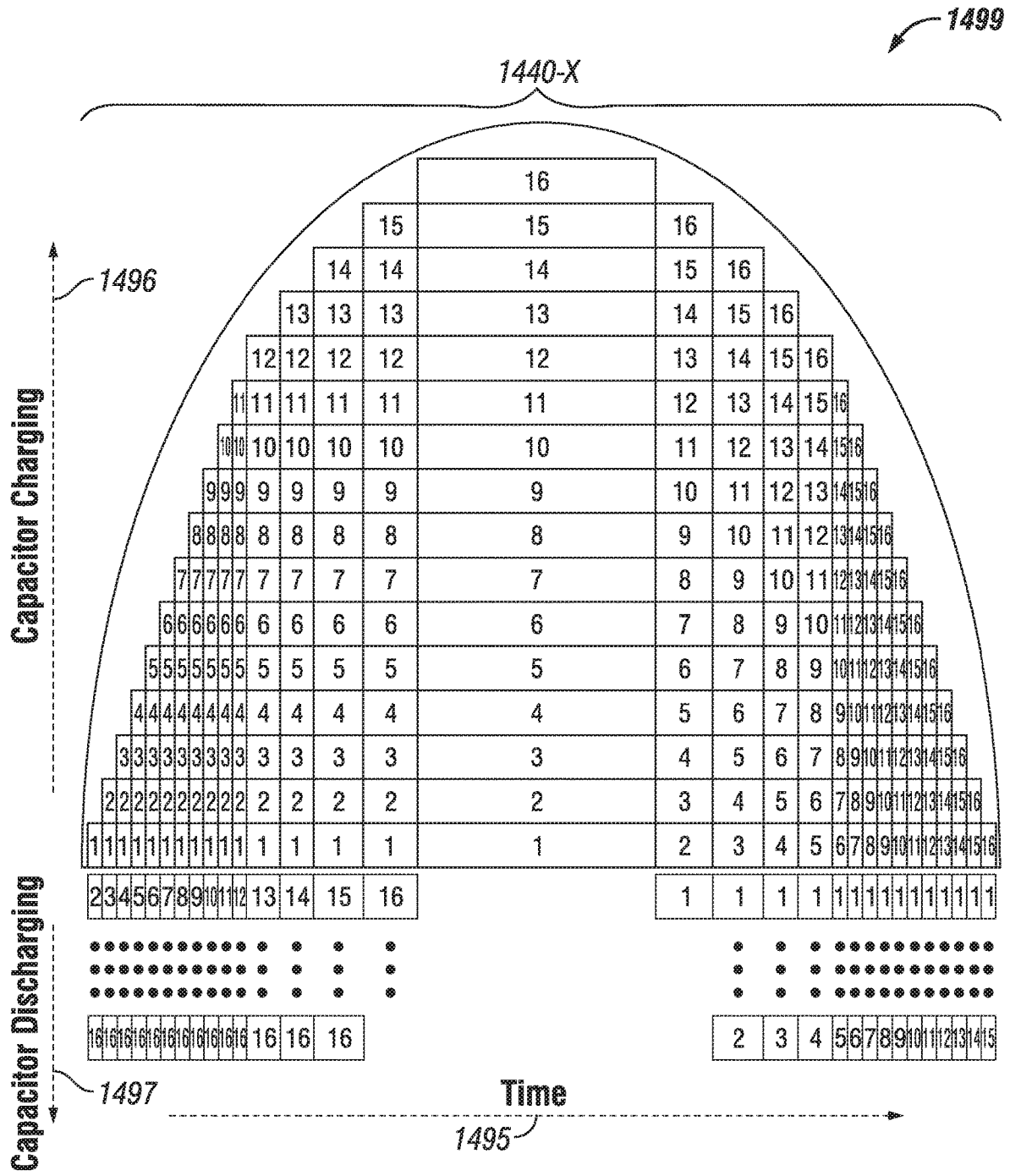

FIGS. 13 and 14 show a distribution plot of light sources for a light fixture in accordance with one or more example embodiments. Specifically, FIG. 13 shows a distribution plot 1399 covering a time 1395 of one full cycle, and FIG. 14 shows a distribution plot 1499 covering a time 1495 of one half cycle. Referring to FIGS. 1-14, distribution plot 1399 and distribution plot 1499 are substantially the same as distribution plot 599 of FIG. 5, except as described below. In both of these cases (distribution plot 1399 and distribution plot 1499), there are 16 light loads (as opposed to only 3 in the distribution plot 599 of FIG. 5).

In the distribution plot 1399 of FIG. 13, the controller controls the various switches (and so activates and deactivates the various light loads) on a first on, first off basis. Further, half of the light loads 1340 (in this case, light load 1340-1 through light load 1340-8) are used in one half-cycle, and the other light loads 1340 (in this case, light load 1340-9 through light load 1340-16) are used in the other half-cycle. As discussed above, when a particular switch is closed, power flows through the switch to the corresponding light load, and the corresponding energy storage device is charging 1396. Conversely, when a particular switch is open, the corresponding energy storage device is discharging 1397 to provide power to corresponding light load. This configuration can be used, for example, when the light fixture operates at 120 VAC.

In the distribution plot 1499 of FIG. 14, the controller again controls the various switches (and so activates and deactivates the various light loads) on a first on, first off basis. By contrast, however, all 16 light loads 1440 are used in each half-cycle. As discussed above, when a particular switch is closed, power flows through the switch to the corresponding light load, and the corresponding energy storage device is charging 1496. Conversely, when a particular switch is open, the corresponding energy storage device is discharging 1497 to provide power to corresponding light load. This configuration can be used, for example, when the light fixture operates at 277 VAC. Again, the embodiments of FIGS. 13 and 14 show how the same lighting system can be used over a wide range of nominal voltages with example embodiments.

Figure 15:
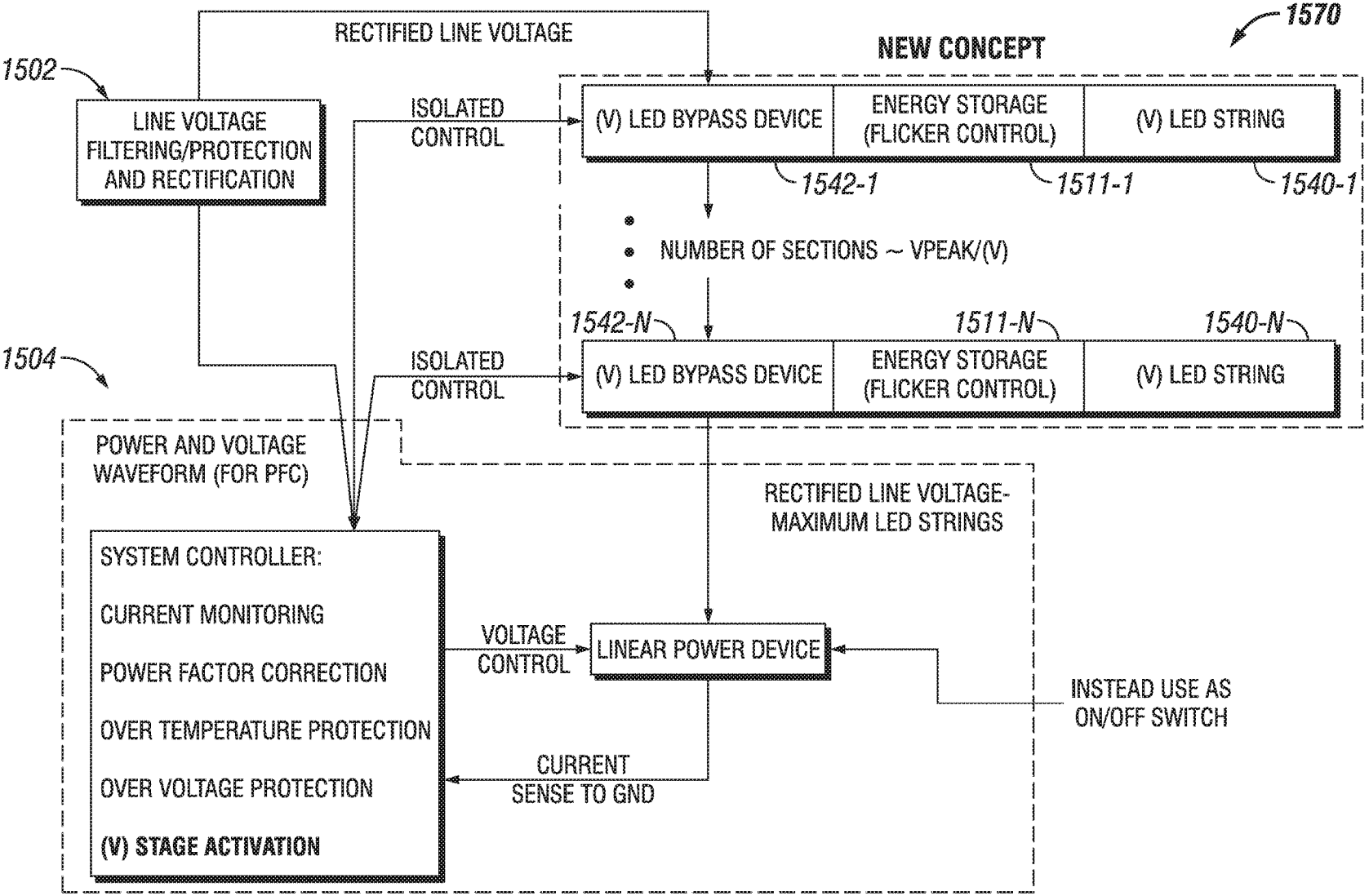
FIG. 15 shows a block diagram of another light fixture in accordance with one or more example embodiments.

FIG. 15 shows a block diagram 1570 of another light fixture in accordance with one or more example embodiments. Referring to FIGS. 1-15, the block diagram 1570 of FIG. 15 is substantially the same as the block diagram 770 of FIG. 7, except as described below. For example, the current that flows through the various light loads 1540 can be regulated by managing (using the switches 1542) which of the light loads 1540 (e.g., light load 1540-1, light load 1540-N) are in the circuit based on the line voltage, provided by the power supply 1502. In this way, a FET (such as FET 868 in FIG. 8 above) is not needed, and therefore removed, from the circuit.

In this way, if the forward voltage of the light loads 1540 is known, and if the transfer function is known (in other words, if the amount of current that would result from applying the forward voltage to the light loads 1540 is also known), then the various light loads 1540 could be turned on and off by the example controller 1504 at different times to get a predictable current through them. While this would decrease the power factor by causing an unsmooth current waveform, significantly less heat would be generated because there would be less voltage across the various switches 1542 (e.g., switch 1542-1, switch 1542-N).

Figure 16:
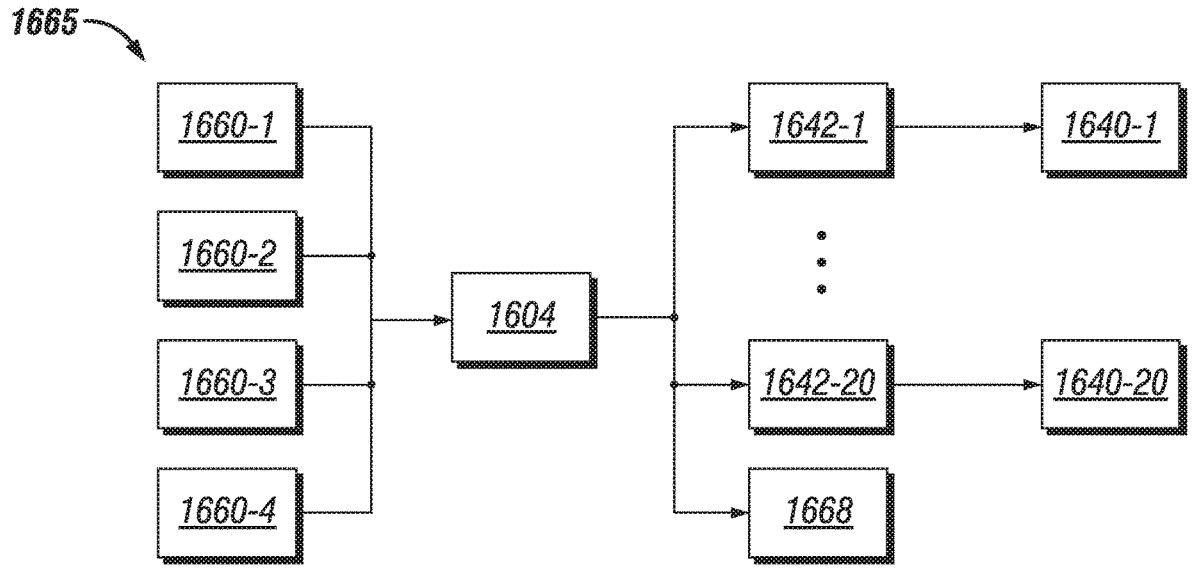
FIG. 16 shows a process flow diagram of a light fixture in accordance with one or more example embodiments.

FIG. 16 shows a process flow diagram 1665 of a light fixture in accordance with one or more example embodiments. Referring to FIGS. 1-16, the interactive controller 1604 receives one or more of a number of inputs (through one or more signal transfer links 1613) and generates one or more of a number of outputs (through one or more other signal transfer links 1613). The inputs, which can generally be referred to as environmental conditions herein, can come from any of a number of sources. For example, as shown in FIG. 16, the inputs can come from a number of sensors 1660. Specifically, sensor 1660-1 can measure current flowing through one or more of the light loads, sensor 1660-2 can measure the line voltage, sensor 1660-3 can measure the temperature of one or more of the switches, and sensor 1660-4 can measure the temperature of one or more light sources of one or more light loads. The sensors 1660 of FIG. 16 are substantially similar to the sensors 2460 described in more detail below with respect to FIG. 24A, and the signal transfer links 1613 are substantially similar to the signal transfer links 2413 described in more detail below with respect to FIG. 24A.

To generate the outputs, the controller 1604 can use some or all of the inputs, as well as other information (e.g., algorithms, historical data, user preferences). The outputs can be delivered to any of a number of components. For example, as shown in FIG. 16, the outputs can be delivered to the switches 1642. Specifically, in this example, there are 20 light loads, and so there are 20 outputs of the controller 1604 that control the switches 1642 (e.g., switch 1642-1, switch 1642-20) associated with each light load. In addition, in this example, an output of the controller 1604 is delivered to the FET 1668 (which can be similar to FET 868 in FIG. 8 above) to turn the FET 1668 on or off. The example controller 1604 is described in more detail below with respect to FIGS. 24A and 24B.

Figure 17:
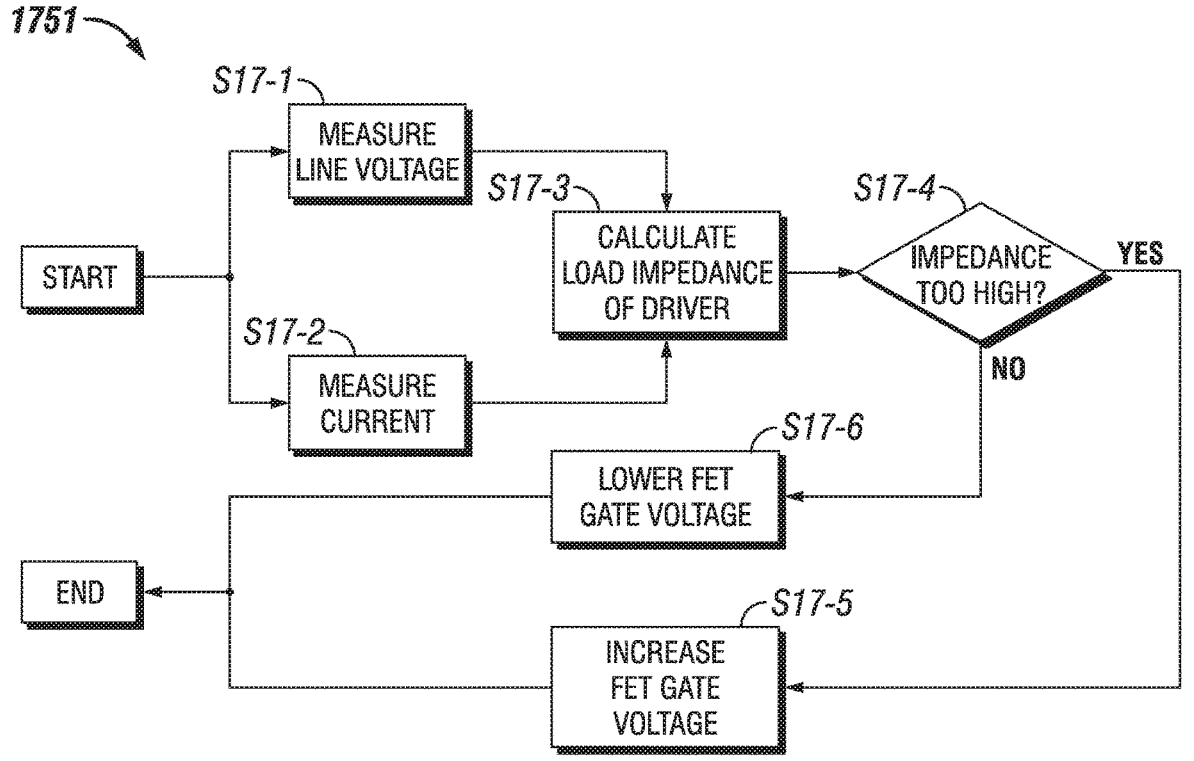
FIGS. 17 and 18 show flow diagrams of methods performed by a light fixture in accordance with one or more example embodiments.
Figure 18:
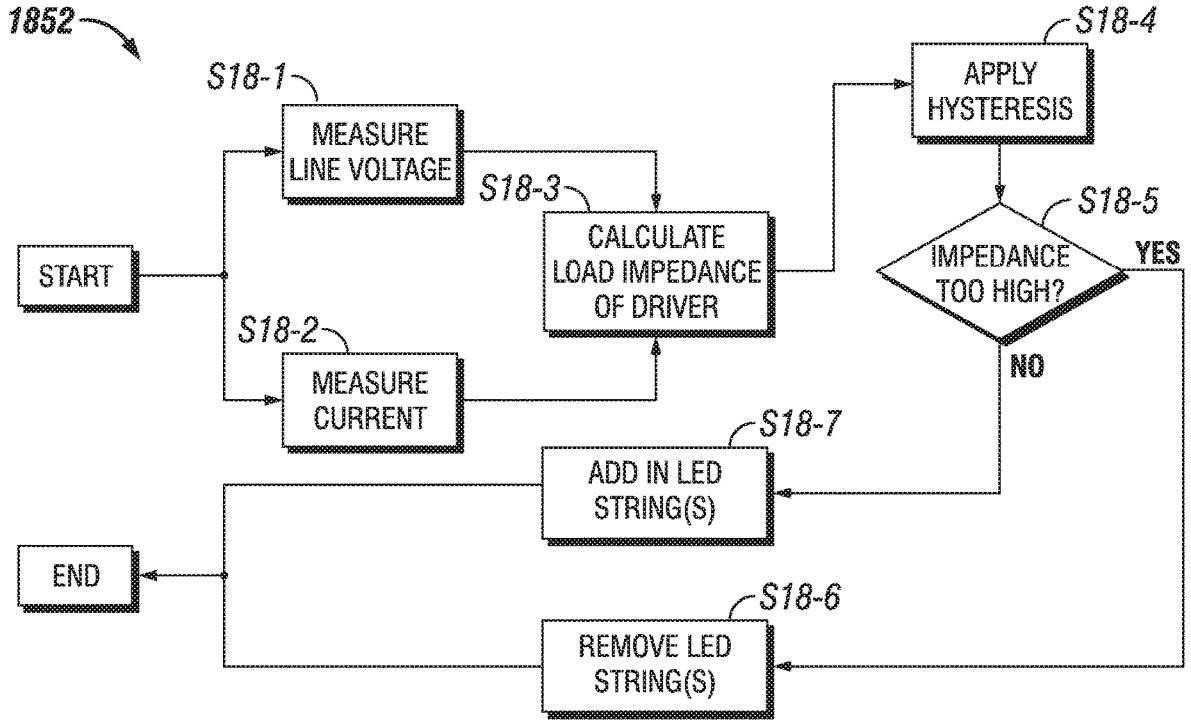

FIGS. 17 and 18 show flow diagrams of methods performed by a light fixture in accordance with one or more example embodiments. While the various steps in these flow charts are presented and described sequentially, one of ordinary skill in the art will appreciate that some or all of the steps can be executed in different orders, combined or omitted, and some or all of the steps can be executed in parallel depending upon the example embodiment. Further, in one or more of the example embodiments, one or more of the steps described below can be omitted, repeated, and/or performed in a different order. Accordingly, the specific arrangement of steps should not be construed as limiting the scope. Further, a particular computing device, as described, for example, in FIG. 25 below, can be used to perform one or more of the steps for the methods described below in certain example embodiments.

Referring to FIGS. 1-17, the flow diagram 1751 of FIG. 17 corresponds to the circuit shown in FIG. 8. The example method of FIG. 17 begins at the START step and proceeds to both step S17-1, where the line voltage is measured, and step S17-2, where the current flowing through one or more light loads 840 is measured. The voltage and current (as well as other environmental conditions in some cases) can be measured by one or more sensors, such as sensors 2460 in FIG. 24A below. In step S17-3, the controller 804 uses these current and voltage measurements to calculate the load impedance of the power supply 802. In step S17-4, a determination is made as to whether the load impedance of the power supply 802 is too high (relative to some threshold value). This determination is made by the controller 804. If the load impedance is too high, then the process proceeds to step S17-5, where the controller 804 increases the gate voltage of the FET (e.g., FET 868) by operating one or more of the switches 842. If the load impedance is not too high (relative to some threshold value), then the process proceeds to step S17-6, where the controller 804 can cause the gate voltage of the FET to be maintained or decreased by operating (or not operating) one or more switches 842. After step S17-5 and step S17-6 are complete, the process proceeds to the END step.

In the flow diagram 1852 of FIG. 18 corresponds to the circuit shown in FIG. 15. The example method of FIG. 17 begins at the START step and proceeds to both step S18-1, where line voltage is measured, and step S18-2, where current flowing through one or more light loads 1540 are measured. The voltage and current (as well as other environmental conditions in some cases) can be measured by one or more sensors, such as sensors 2460 in FIG. 24A below. In step S18-3, the controller 1504 uses these measurements to calculate the load impedance of the power supply 1502. Since there is no FET (e.g., FET 868) in this circuit, hysteresis can be applied in step S18-4 to slow down the control loop so that the light loads 1540 are not turned on and off too fast by the controller 1504.

In step S18-5, a determination is made as to whether the load impedance of the power supply 1502 is too high (relative to some threshold value). This determination is made by the controller 1504. If the load impedance is too high (relative to some threshold value), then the process proceeds to step S18-6, where the controller 1504 can add in one or more particular (e.g., first in) light loads 1540. If the load impedance is not too high (relative to some threshold value), then the process proceeds to step S18-7, where the controller 1504 can remove one or more particular light loads 1540. After step S18-6 and step S18-7 are complete, the process proceeds to the END step.

Figure 19:
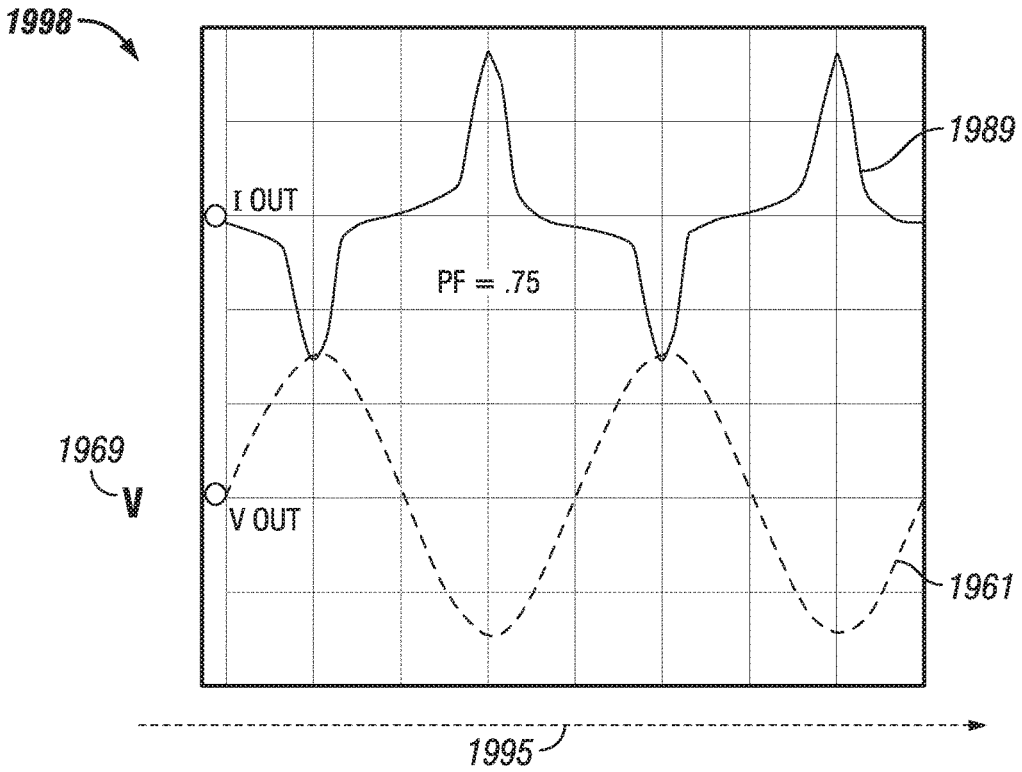
FIG. 19 shows a plot of current and voltage for a light fixture in accordance with one or more example embodiments.

FIG. 19 shows a plot 1998 of current 1989 and voltage 1961 over time 1995 for a light fixture in accordance with one or more example embodiments. Referring to FIGS. 1-19, the current 1989 flowing through the light loads is not sinusoidal, and so the power factor is lower (in this case, approximately 0.75) than the power factor achieved in the current art. As discussed above, the minimum power factor required in certain applicable standards for light fixtures is 0.9. This can easily be obtained using example embodiments.

Figure 20:
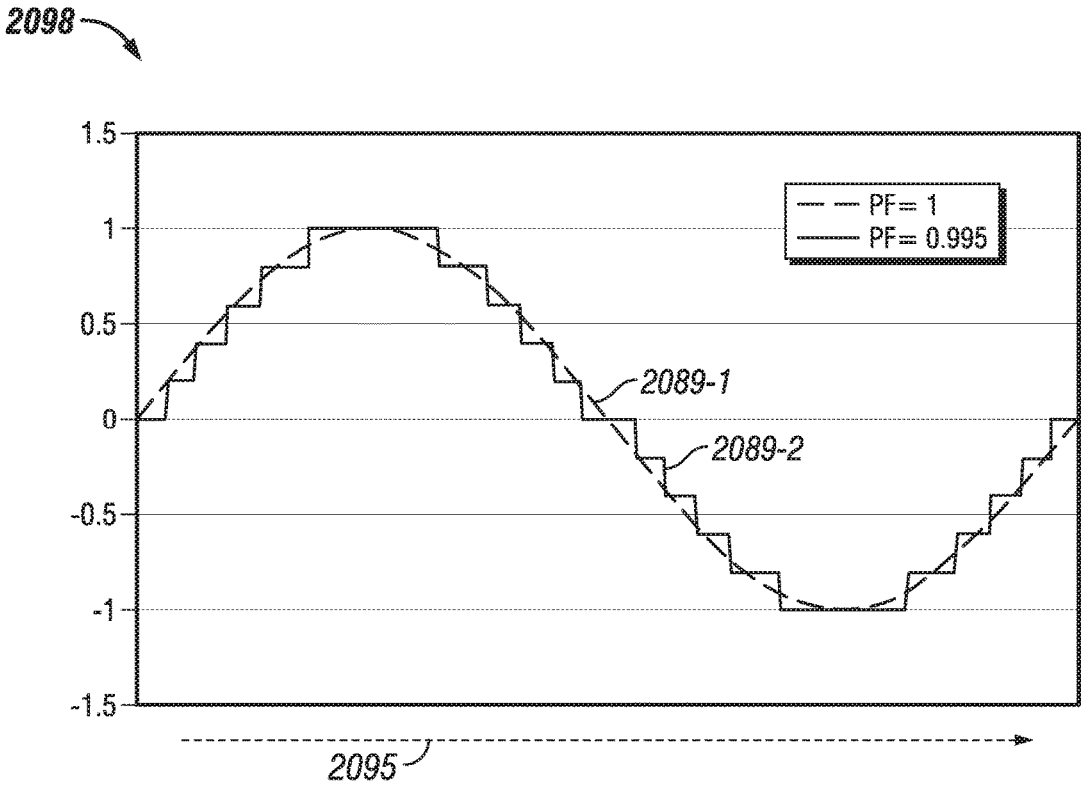
FIG. 20 shows a plot of current for a light fixture in accordance with one or more example embodiments.

For example, FIG. 20 shows a plot 2098 of current 2089 for a light fixture in accordance with one or more example embodiments. When the current 2089-1 is nearly sinusoidal, as in the current art, the power factor approaches 1.0. By contrast, when the current 2089-2 is in the shape of course steps, as shown in FIG. 20, the power factor is approximately 0.995, which still greatly exceeds the minimum requirement of 0.9.

Figure 21:
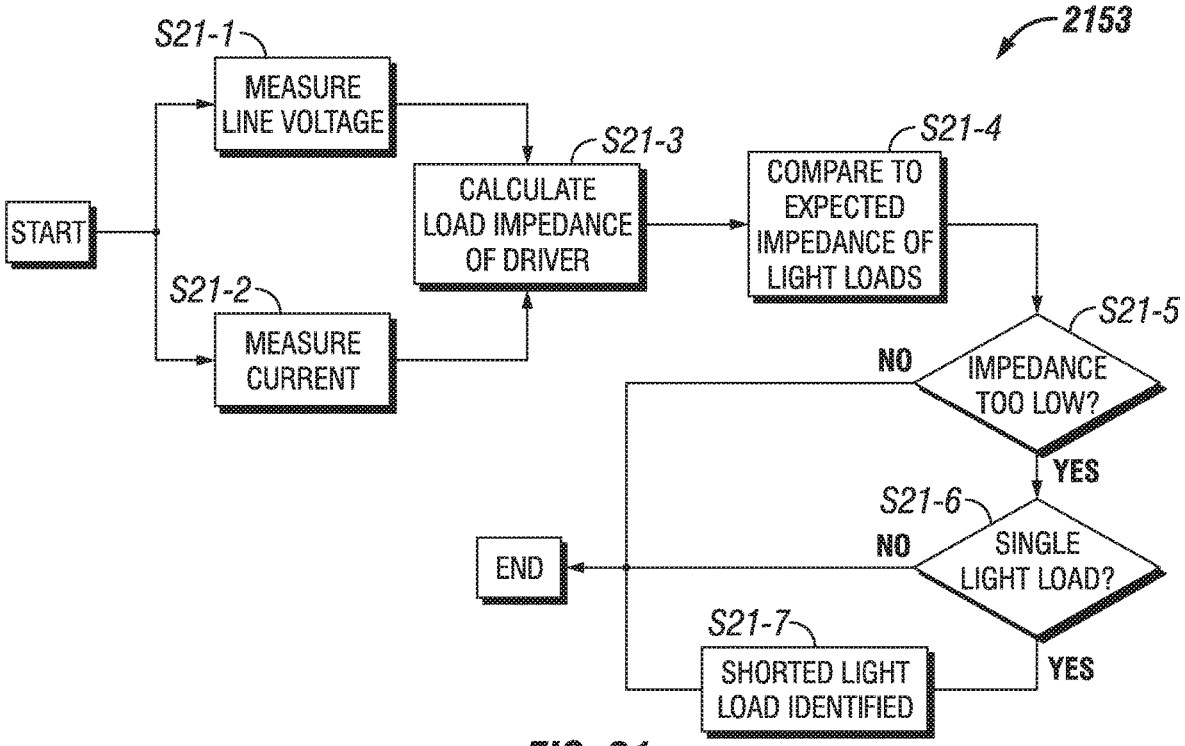
FIGS. 21-23 show flow diagrams of methods performed by a light fixture in accordance with one or more example embodiments.
Figure 22:
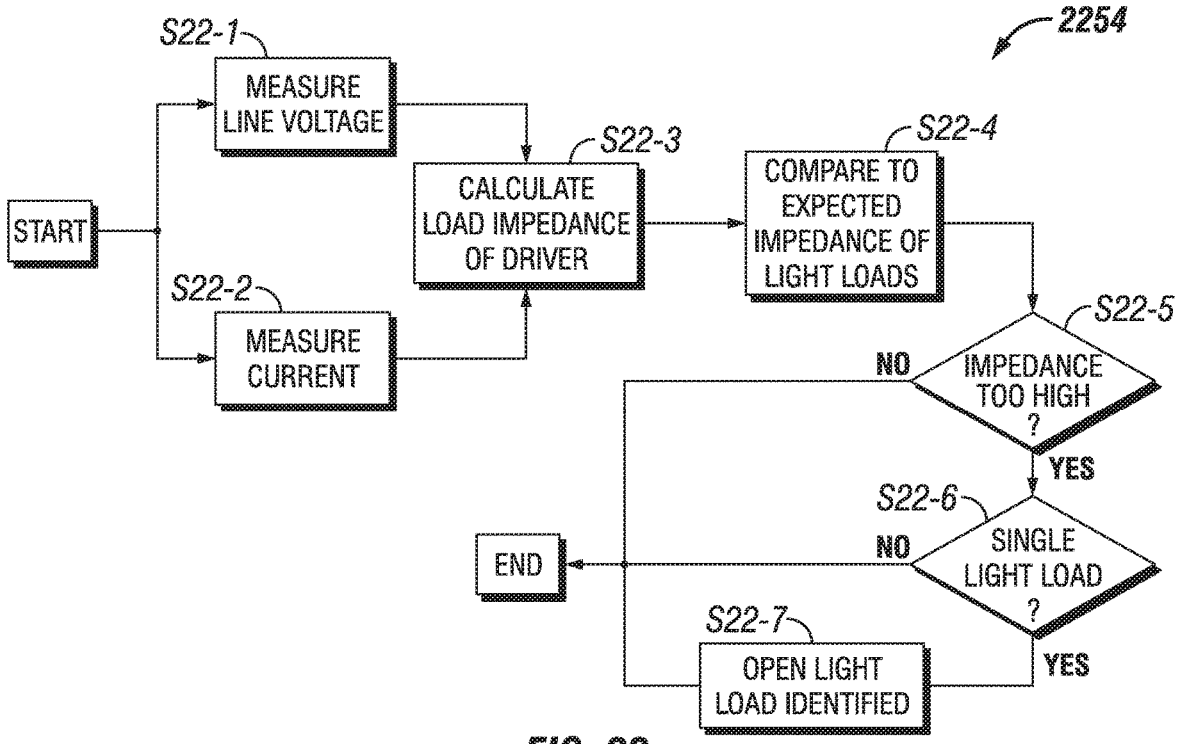
Figure 23:
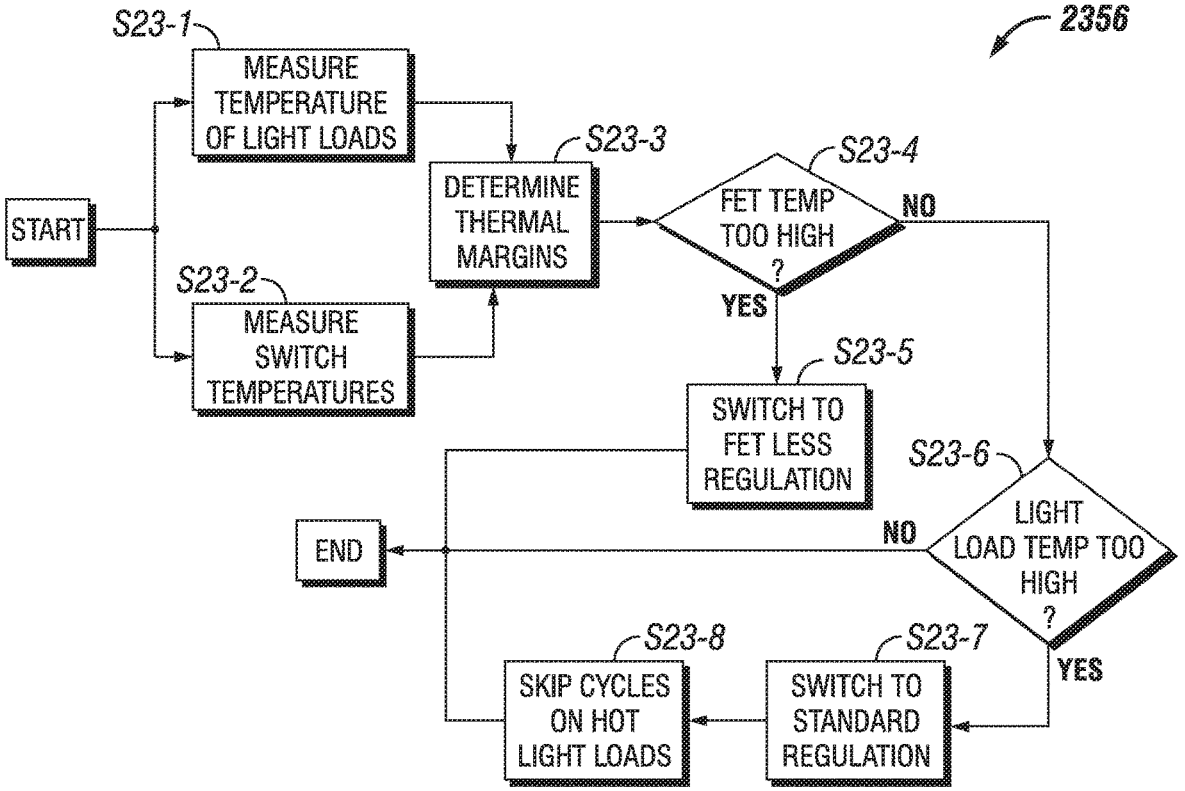

FIGS. 21-23 show flow diagrams of methods performed by a light fixture in accordance with one or more example embodiments. While the various steps in these flowcharts are presented and described sequentially, one of ordinary skill in the art will appreciate that some or all of the steps can be executed in different orders, combined or omitted, and some or all of the steps can be executed in parallel depending upon the example embodiment. Further, in one or more of the example embodiments, one or more of the steps described below can be omitted, repeated, and/or performed in a different order. Accordingly, the specific arrangement of steps should not be construed as limiting the scope. Further, a particular computing device, as described, for example, in FIG. 25 below, can be used to perform one or more of the steps for the methods described below in certain example embodiments.

Referring to FIGS. 1-23, the flow diagram 2153 of FIG. 21 shows a process followed using certain example embodiments to determine whether a particular light load has shorted. The example method of FIG. 21 begins at the START step and proceeds to both step S21-1, where the line voltage is measured, and step S21-2, where the current flowing through one or more light loads (e.g., light load 1540) are measured. The voltage and current (as well as other environmental conditions in some cases) can be measured by one or more sensors, such as sensors 2460 in FIG. 24A below. In step S21-3, the controller (e.g., controller 1504) uses these current and voltage measurements to calculate the load impedance of the power supply (e.g., power supply 1502).

In step S21-4, a comparison is made to the expected impedance of the light loads. In certain example embodiments, the controller (e.g., controller 1504) retrieves the expected impedance values and performs the comparison. In step S21-5, a determination is made as to whether the impedance is too low. This determination is made by the example controller. If the load impedance is too low (relative to some threshold value), the process proceeds to step S21-6. If the load impedance is not too low (relative to some threshold value), the process proceeds to the END step.

In step S21-6, a determination is made as to whether there is a single light load involved in making the impedance too low. This determination is made by the example controller. If there is a single light load involved, then the process proceeds to step S21-7, where the controller can identify the shorted light load and avoid using that light load. The controller can also notify a user that the light load needs to be repaired or replaced. After step S21-7 is completed, the process proceeds to the END step. If there is not a single light load involved, then the process proceeds to the END step.

The flow diagram 2254 of FIG. 22 shows a process followed using certain example embodiments to determine whether a particular light load is part of an open circuit. The example method of FIG. 22 begins at the START step and proceeds to both step S22-1, where the line voltage is measured, and step S22-2, where the current flowing through one or more light loads (e.g., light load 1540) are measured. The voltage and current (as well as other environmental conditions in some cases) can be measured by one or more sensors, such as sensors 2460 in FIG. 24A below. In step S22-3, the controller (e.g., controller 1504) uses these current and voltage measurements to calculate the load impedance of the power supply (e.g., power supply 1502).

In step S22-4, a comparison is made to the expected impedance of the light loads. In certain example embodiments, the controller retrieves the expected impedance values and performs the comparison. In step S22-5, a determination is made as to whether the impedance is too high. This determination is made by the example controller. If the load impedance is too high (relative to some threshold value), the process proceeds to step S22-6. If the load impedance is not too high (relative to some threshold value), the process proceeds to the END step.

In step S22-6, a determination is made as to whether there is a single light load involved in making the impedance too high. This determination is made by the example controller. If there is a single light load involved, then the process proceeds to step S22-7, where the controller can identify the open light load and avoid using that light load. The controller can also notify a user that the light load needs to be repaired or replaced. After step S22-7 is completed, the process proceeds to the END step. If there is not a single light load involved, then the process proceeds to the END step.

The flow diagram 2356 of FIG. 23 shows a process followed using certain example embodiments to thermally manage the components of the circuit. The example method of FIG. 23 begins at the START step and proceeds to both step S23-1, where temperatures of one or more light loads (e.g., light load 1540) are measured, and step S23-2, where the temperatures of one or more switches (e.g., switch 1542) are measured. In addition, or in the alternative, the temperature of a FET (such as the FET that is part of the controller 804 in FIG. 8 above) can be measured. The temperatures (as well as other environmental conditions in some cases) can be measured by one or more sensors, such as sensors 2460 in FIG. 24A below.

In step S23-3, the thermal margins of those components are determined. The thermal margins can be determined by the controller (e.g., controller 1504). In step S23-4, a determination can be made as to whether the temperature of the FET, switches, and/or the light loads is too high (relative to some threshold value). This determination can be made by the controller. In this example, if the temperature of the FET is too high, then the process proceeds to step S23-5, where the controller can remove the FET from operation (e.g., change from the block diagram 870 of FIG. 8 to the block diagram 1570 of FIG. 15). If the temperature of the FET is not too high, then the process proceeds to step S23-6.

In step S23-6, a determination is made as to whether the temperature of a light load is too high. This determination can be made by the controller. If the temperature of a light load is too high, then the process proceeds to step S23-7, where the controller can change to a standard mode of regulation and/or to step S23-8, where the controller can manipulate one or more switches to skip one or more cycles for a light load with an elevated temperature. After step S23-7 and/or step S23-8 are complete, the process proceeds to the END step. In certain example embodiments, the controller can also notify a user that a particular switch and/or light load may need to be repaired or replaced. If the temperature of a light load is not too high, then the process proceeds to the END step.

Figure 24A:
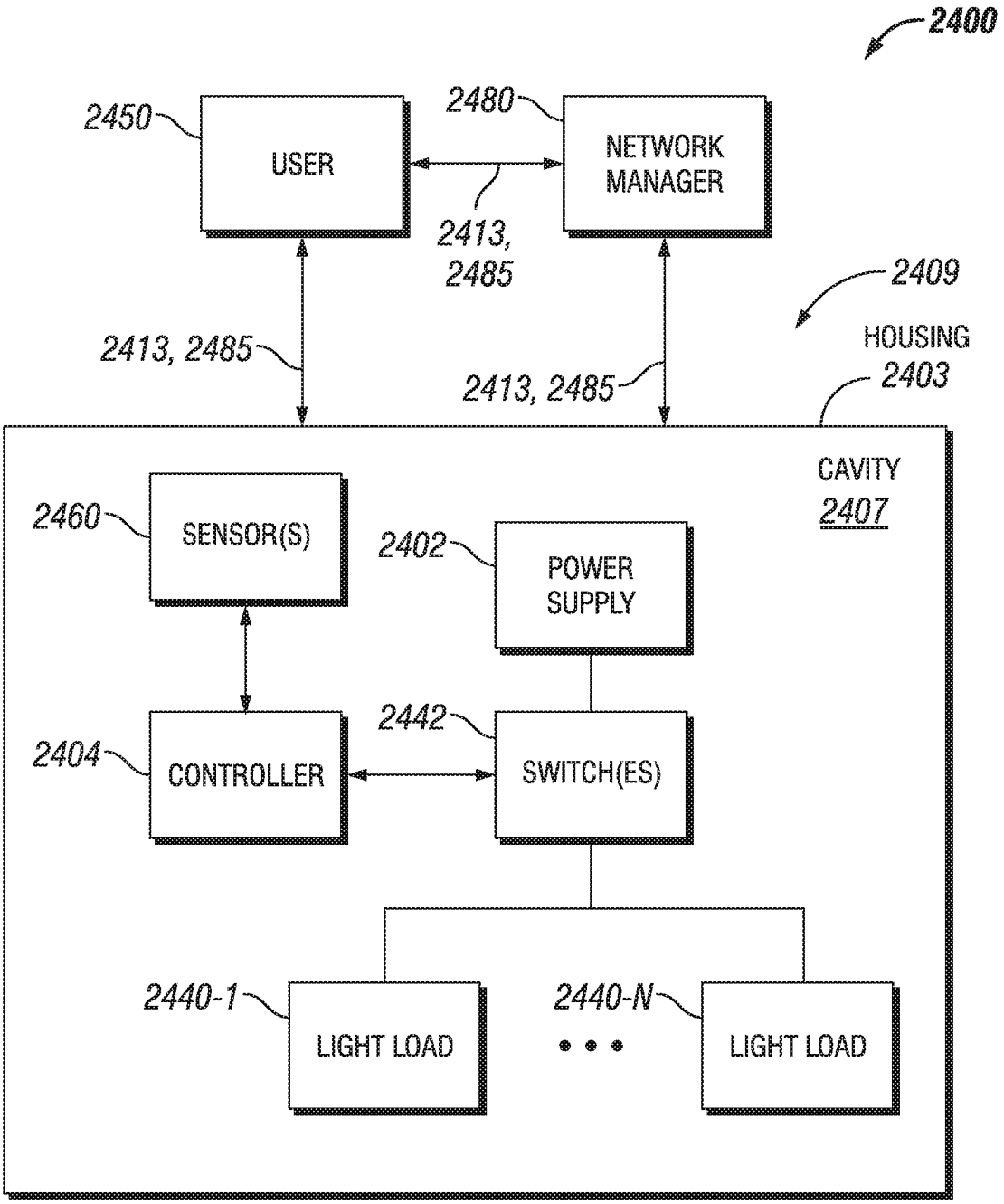
FIGS. 24A and 24B show a system diagram of a lighting system that includes a light fixture in accordance with certain example embodiments.
Figure 24B:
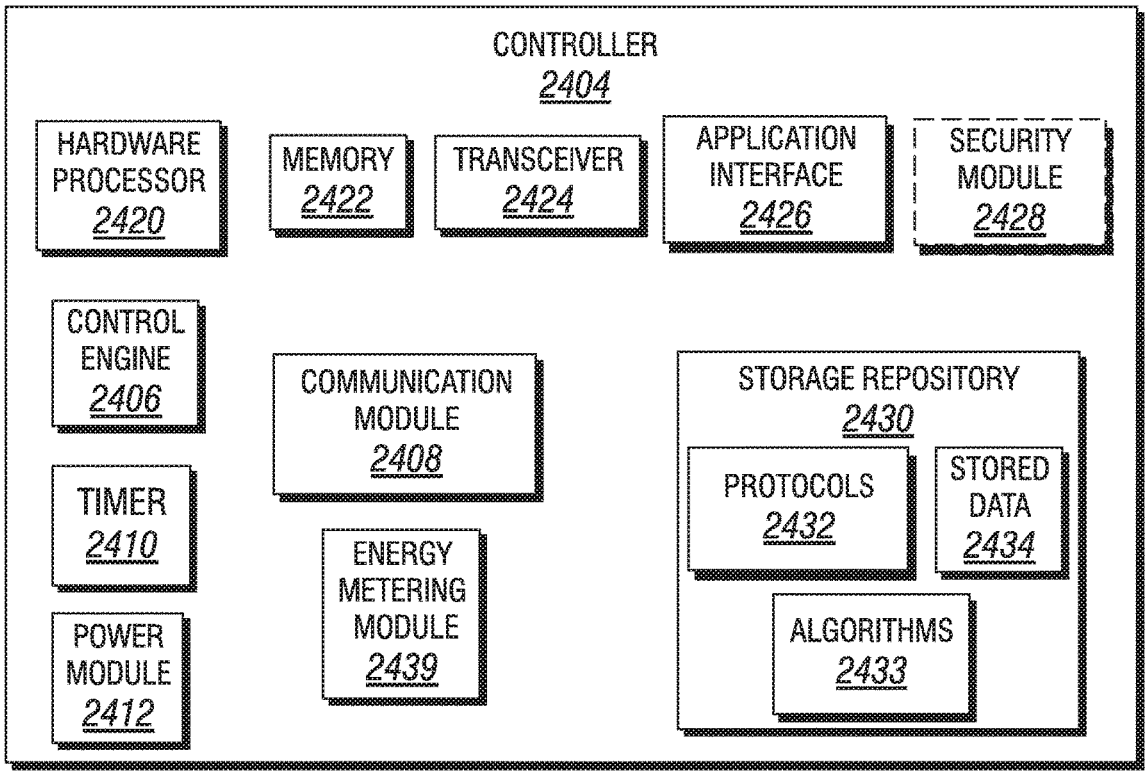

FIGS. 24A and 24B show a system diagram of a lighting system 2400 that includes active control of a light fixture 2409 in accordance with certain example embodiments. Specifically, FIG. 24A shows the lighting system 2400, and FIG. 24B shows a detailed system diagram of a controller 2404. Referring to FIGS. 1-24B, the lighting system 2400 can include one or more components. For example, as shown in FIGS. 24A and 24B, the lighting system 2400 can include one or more sensors 2460 (also sometimes called sensor modules 2460), a user 2450, a network manager 2480, and at least one light fixture 2409. In addition to the controller 2404 and the sensors 2460, the light fixture 2409 can include a power supply 2402, one or more switches 2442, and one or more light loads 2440. The power supply 2402 can be substantially similar to the power supplies discussed above. The power supply 2402 can include one or more of any number of components, including but not limited to a transformer, a rectifier, a fuse, an inverter, and a converter.

As shown in FIG. 24B, the controller 2404 can include one or more of a number of components. Such components, can include, but are not limited to, a control engine 2406, a communication module 2408, a timer 2410, an energy metering module 2439, a power module 2412, a storage repository 2430, a hardware processor 2420, a memory 2422, a transceiver 2424, an application interface 2426, and, optionally, a security module 2428. The components shown in FIGS. 24A and 24B are not exhaustive, and in some embodiments, one or more of the components shown in FIGS. 24A and 24B may not be included in an example light fixture. Further, one or more components shown in FIGS. 24A and 24B can be rearranged. For example, one or more of the switches 2442 can be part of the controller 2404 of FIG. 24B. Any component of the example light fixture 2409 can be discrete or combined with one or more other components of the light fixture 2409.

In some example embodiments, the light fixture 2409 is actually a lighting system that includes a number of light fixtures. In such a case, each light load 2440 can be part of an individual light fixture in the lighting system. Further, one or more of the components shown and described in FIGS. 24A and 24B can be unique to one (or less than all) of the light fixtures in the lighting system or shared by multiple light fixtures in the lighting system.

A user 2450 may be any person that interacts with light fixtures or other devices that use example embodiments. Examples of a user 2450 may include, but are not limited to, an engineer, an electrician, an instrumentation and controls technician, a mechanic, an operator, a consultant, an inventory management system, an inventory manager, a foreman, a labor scheduling system, a contractor, and a manufacturer's representative. The user 2450 can use a user system (not shown), which may include a display (e.g., a GUI). The user 2450 interacts with (e.g., sends data to, receives data from) the controller 2404 of the light fixture 2409 via the application interface 2426 (described below). The user 2450 can also interact with a network manager 2480 and/or one or more of the sensors 2460. Interaction between the user 2450 and the light fixture 2409, the network manager 2480, and the sensors 2460 is conducted using signal transfer links 2413 and/or power transfer links 2485.

Each signal transfer link 2413 and each power transfer link 2485 can include wired (e.g., Class 1 electrical cables, Class 2 electrical cables, electrical connectors, electrical conductors, electrical traces on a circuit board, power line carrier, DALI, RS485) and/or wireless (e.g., Wi-Fi, visible light communication, cellular networking, Bluetooth, WirelessHART, ISA100, inductive power transfer) technology. For example, a signal transfer link 2413 can be (or include) one or more electrical conductors that are coupled to the housing 2403 of the light fixture 2409 and to a sensor 2460. A signal transfer link 2413 can transmit signals (e.g., communication signals, control signals, data) between the light fixture 2409 and the user 2450, the network manager 2480, and/or one or more of the sensors 2460. Similarly, a power transfer link 2485 can transmit power between the light fixture 2409 and the user 2450, the network manager 2480, and/or one or more of the sensors 2460. One or more signal transfer links 2413 and/or one or more power transfer links 2485 can also transmit signals and power, respectively, between components (e.g., controller 2404, sensor 2460, switch 2442) within the housing 2403 of the light fixture 2409.

The network manager 2480 is a device or component that can communicate with the light fixture 2409. For example, the network manager 2480 can send instructions to the controller 2404 of the light fixture 2409 as to when certain switches 2442 should be dynamically operated (change state). As another example, the network manager 2480 can receive data (e.g., run time, current flow) associated with the operation of each power supply 2402 from the light fixture 2409 to determine when maintenance should be performed on the light fixture 2409 or portions thereof.

The one or more sensors 2460 can be any type of sensing device that measure one or more parameters (also called environmental conditions). Examples of types of sensors 2460 can include, but are not limited to, a resistor, a Hall Effect current sensor, a thermistor, a vibration sensor, an accelerometer, a passive infrared sensor, a photocell, and a resistance temperature detector. A parameter that can be measured by a sensor 2460 can include, but is not limited to, current, voltage, power, resistance, vibration, position, and temperature. In some cases, the parameter or parameters measured by a sensor 2460 can be used to dynamically operate one or more light loads 2440 of the light fixture 2409. Each sensor 2460 can use one or more of a number of communication protocols. A sensor 2460 can be associated with the light fixture 2409 or another light fixture in the system 2400. A sensor 2460 can be located within the housing 2403 of the light fixture 2409 (as shown in FIG. 24A), disposed on the housing 2403 of the light fixture 2409, or located outside the housing 2403 of the light fixture 2409.

The user 2450, the network manager 2480, and/or the sensors 2460 can interact with the controller 2404 of the light fixture 2409 using the application interface 2426 in accordance with one or more example embodiments. Specifically, the application interface 2426 of the controller 2404 receives data (e.g., information, communications, instructions, updates to firmware) from and sends data (e.g., information, communications, instructions) to the user 2450, the network manager 2480, and/or each sensor 2460. The user 2450, the network manager 2480, and/or each sensor 2460 can include an interface to receive data from and send data to the controller 2404 in certain example embodiments. Examples of such an interface can include, but are not limited to, a graphical user interface, a touchscreen, an application programming interface, a keyboard, a monitor, a mouse, a web service, a data protocol adapter, some other hardware and/or software, or any suitable combination thereof.

The controller 2404, the user 2450, the network manager 2480, and/or the sensors 2460 can use their own system or share a system in certain example embodiments. Such a system can be, or contain a form of, an Internet-based or an intranet-based computer system that is capable of communicating with various software. A computer system includes any type of computing device and/or communication device, including but not limited to the controller 2404. Examples of such a system can include, but are not limited to, a desktop computer with a Local Area Network (LAN), a Wide Area Network (WAN), Internet or intranet access, a laptop computer with LAN, WAN, Internet or intranet access, a smart phone, a server, a server farm, an android device (or equivalent), a tablet, smartphones, and a PDA. Such a system can correspond to a computer system as described below with regard to FIG. 25.

Further, as discussed above, such a system can have corresponding software (e.g., user software, sensor software, controller software, network manager software). The software can execute on the same or a separate device (e.g., a server, mainframe, desktop personal computer (PC), laptop, PDA, television, cable box, satellite box, kiosk, telephone, mobile phone, or other computing devices) and can be coupled by the communication network (e.g., Internet, Intranet, Extranet, LAN, WAN, or other network communication methods) and/or communication channels, with wire and/or wireless segments according to some example embodiments. The software of one system can be a part of, or operate separately but in conjunction with, the software of another system within the system 2400.

The light fixture 2409 can include a housing 2403. The housing 2403 can include at least one wall that forms a cavity 2407. In some cases, the housing can be designed to comply with any applicable standards so that the light fixture 2409 can be located in a particular environment (e.g., a hazardous environment). For example, if the light fixture 2409 is located in an explosive environment, the housing 2403 can be explosion-proof. According to applicable industry standards, an explosion-proof enclosure is an enclosure that is configured to contain an explosion that originates inside, or can propagate through, the enclosure.

The housing 2403 of the light fixture 2409 can be used to house one or more components of the light fixture 2409, including one or more components of the controller 2404. For example, as shown in FIGS. 24A and 24B, the controller 2404 (which in this case includes the control engine 2406, the communication module 2408, the timer 2410, the energy metering module 2439, the power module 2412, the storage repository 2430, the hardware processor 2420, the memory 2422, the transceiver 2424, the application interface 2426, and the optional security module 2428), the power supply 2402, and the light loads 2440 are disposed in the cavity 2407 formed by the housing 2403. In alternative embodiments, any one or more of these or other components of the light fixture 2409 can be disposed on the housing 2403 and/or remotely from the housing 2403.

The storage repository 2430 can be a persistent storage device (or set of devices) that stores software and data used to assist the controller 2404 in communicating with the user 2450, the network manager 2480, and one or more sensors 2460 within the system 2400. In one or more example embodiments, the storage repository 2430 stores one or more communication protocols 2432, algorithms 2433, and stored data 2434. The protocols can be any procedures (e.g., a series of method steps, such as those shown and described above with respect to FIGS. 17, 18, and 21-23) and/or other similar operational procedures that the control engine 2406 of the controller 2404 follows based on certain conditions at a point in time. The protocols 2432 can include any of a number of communication protocols that are used to send and/or receive data between the controller 2404 and the user 2450, the network manager 2480, and one or more sensors 2460.

A protocol 2432 can be used for wired and/or wireless communication. Examples of a protocol 2432 can include, but are not limited to, Modbus, profibus, Ethernet, and fiberoptic. One or more of the communication protocols 2432 can be a time-synchronized protocol. Examples of such time-synchronized protocols can include, but are not limited to, a highway addressable remote transducer (HART) protocol, a wirelessHART protocol, and an International Society of Automation (ISA) 100 protocol. In this way, one or more of the communication protocols 2432 can provide a layer of security to the data transferred within the system 2400.

The algorithms 2433 can be any formulas, logic steps, mathematical models, and/or other suitable means of manipulating and/or processing data. One or more algorithms 2433 can be used for a particular protocol 2432. For example, a protocol 2432 can call for measuring (using the energy metering module 2439), storing (using the stored data 2434 in the storage repository 2430), and evaluating (using an algorithm 2433) the current and voltage delivered to a particular light load 2440 at a particular point in time.

If the current and/or voltage delivered to a particular light load 2440 falls outside a range of acceptable values (e.g., exceeds a threshold value), then one or more switches 2442 can change state (by the control engine 2406) to change the temporarily or permanently bypass the particular light load 2440, thereby disabling the light load 2440. Alternatively, a protocol 2432 can be used to direct the control engine 2406 to dynamically operate one or more of the switches 2442 based on some other factor, including but not limited to a passage of time. As another example, a protocol 2432 can be used to direct the control engine 2406 to continuously (dynamically) operate the various switches 2442 to enable and disable the light loads 2440 at different points in time based on conditions (e.g., current measured by the energy metering module 2439 and stored as stored data 2434) relative to the light fixture 2409.

Stored data 2434 can be any data associated with the light fixture 2409 (including other light fixtures and/or any components thereof), any measurements taken by the sensors 2460, measurements taken by the energy metering module 2439, time measured by the timer 2410, threshold values, current ratings for the power supply 2402, results of previously run or calculated algorithms, and/or any other suitable data. Such data can be any type of data, including but not limited to historical data for the light fixture 2409 (including any components thereof, such as the power supply 2402 and the light load 2440), historical data for other light fixtures, calculations, measurements taken by the energy metering module 2439, and measurements taken by one or more sensors 2460. The stored data 2434 can be associated with some measurement of time derived, for example, from the timer 2410.

Examples of a storage repository 2430 can include, but are not limited to, a database (or a number of databases), a file system, a hard drive, flash memory, some other form of solid state data storage, or any suitable combination thereof. The storage repository 2430 can be located on multiple physical machines, each storing all or a portion of the protocols 2432, the algorithms 2433, and/or the stored data 2434 according to some example embodiments. Each storage unit or device can be physically located in the same or in a different geographic location.

The storage repository 2430 can be operatively connected to the control engine 2406. In one or more example embodiments, the control engine 2406 includes functionality to communicate with the user 2450, the network manager 2480, and the sensors 2460 in the system 2400. More specifically, the control engine 2406 sends information to and/or receives information from the storage repository 2430 in order to communicate with the user 2450, the network manager 2480, and the sensors 2460. As discussed below, the storage repository 2430 can also be operatively connected to the communication module 2408 in certain example embodiments.

In certain example embodiments, the control engine 2406 of the controller 2404 controls the operation of one or more components (e.g., the communication module 2408, the timer 2410, the transceiver 2424) of the controller 2404. For example, the control engine 2406 can activate the communication module 2408 when the communication module 2408 is in "sleep" mode and when the communication module 2408 is needed to send data received from another component (e.g., switches 2442, a sensor 2460, the user 2450) in the system 2400.

As another example, the control engine 2406 can acquire the current time using the timer 2410. The timer 2410 can enable the controller 2404 to control the light fixture 2409 (including any components thereof, such as the power supply 2402 and one or more switches 2442) even when the controller 2404 has no communication with the network manager 2480. As yet another example, the control engine 2406 can direct the energy metering module 2439 to measure and send power consumption information of a light load 2440 to the network manager 2480. In some cases, the control engine 2406 of the controller 2404 can control the position (e.g., open, closed) of each switch 2442, which allows or prevents the power supply 2402 to provide power to one or more particular light loads 2440.

For example, the control engine 2406 can execute any of the protocols 2432 and/or algorithms 2433 stored in the storage repository 2430 and use the results of those protocols 2432 and/or algorithms 2433 to change the position of one or more switches 2442. As a specific example, the control engine 2406 can follow a protocol 2432 by measuring (using the energy metering module 2439), storing (as stored data 2434 in the storage repository 2430), and evaluating, using an algorithm 2433, the current and voltage delivered by the power supply 2402 to each light load 2440 over time. In this way, the operation of each light load 2440 can be optimized to increase the reliability of the power supply 2402. As another specific example, the control engine 2406 can determine, based on measurements made by the energy metering module 2439, whether a particular light load 2440 has failed. In such a case, the control engine 2406 can change the position of one or more switches 2442 to have another light load receive 2440 receive power from the power supply 2402, thereby bypassing the light load 2440 that failed.

The control engine 2406 can generate an alarm when an operating parameter (e.g., total number of operating hours, number of consecutive operating hours, number of operating hours delivering power above a current level, input power quality, vibration, operating ambient temperature, operating device temperature, and cleanliness (e.g., air quality, fixture cleanliness)) of the light fixture 2409 (or component thereof) exceeds a threshold value, indicating possible present or future failure of the light fixture 2409 (or component thereof). The control engine 2406 can further measure (using one or more sensors 2460) and analyze the magnitude and number of surges that the light fixture 2409 is subjected to over time. Using one or more algorithms 2433, the control engine 2406 can predict the expected useful life of the light fixture 2409 (or a particular component thereof) based on stored data 2434, a protocol 2432, one or more threshold values, and/or some other factor. The control engine 2406 can also measure (using one or more sensors 2460) and analyze the efficiency of the light fixture 2409 (or component thereof) over time. An alarm can be generated by the control engine 2406 when the efficiency of the light fixture 2409 (or component thereof) falls below a threshold value, indicating failure of the light fixture 2409 (or component thereof, such as a particular light load 2440).

The control engine 2406 can provide power, control, communication, and/or other similar signals to the user 2450, the network manager 2480, and one or more of the sensors 2460. Similarly, the control engine 2406 can receive power, control, communication, and/or other similar signals from the user 2450, the network manager 2480, and one or more of the sensors 2460. The control engine 2406 can control each sensor 2460 automatically (for example, based on one or more algorithms stored in the control engine 2406) and/or based on power, control, communication, and/or other similar signals received from another device through a signal transfer link 2413 and/or a power transfer link 2485. The control engine 2406 may include a printed circuit board, upon which the hardware processor 2420 and/or one or more discrete components of the controller 2404 are positioned.

In certain embodiments, the control engine 2406 of the controller 2404 can communicate with one or more components of a system external to the system 2400 in furtherance of optimizing the performance of the light fixture 2409 (or portions thereof). For example, the control engine 2406 can interact with an inventory management system by ordering a component (e.g., a light load 2440) of the light fixture 2409 to replace a component of the light fixture 2409 that the control engine 2406 has determined to fail or be failing. As another example, the control engine 2406 can interact with a workforce scheduling system by scheduling a maintenance crew to repair or replace the light fixture 2409 (or component thereof) when the control engine 2406 determines that the light fixture 2409 (or component thereof) requires maintenance or replacement. In this way, the controller 2404 is capable of performing a number of functions beyond what could reasonably be considered a routine task.

In certain example embodiments, the control engine 2406 can include an interface that enables the control engine 2406 to communicate with one or more components (e.g., a power supply 2402, a switch 2442) of the light fixture 2409. For example, if a power supply 2402 of the light fixture 2409 operates under IEC Standard 62386, then the power supply 2402 can have a serial communication interface that will transfer data (e.g., stored data 2434) measured by the sensors 2460. In such a case, the control engine 2406 can also include a serial interface to enable communication with the power supply 2402 within the light fixture 2409. Such an interface can operate in conjunction with, or independently of, the protocols 2432 used to communicate between the controller 2404 and the user 2450, the network manager 2480, and the sensors 2460.

The control engine 2406 (or other components of the controller 2404) can also include one or more hardware components and/or software elements to perform its functions. Such components can include, but are not limited to, a universal asynchronous receiver/transmitter (UART), a serial peripheral interface (SPI), a direct-attached capacity (DAC) storage device, an analog-to-digital converter, an inter-integrated circuit (IC), and a pulse width modulator (PWM).

The communication module 2408 of the controller 2404 determines and implements the communication protocol (e.g., from the protocols 2432 of the storage repository 2430) that is used when the control engine 2406 communicates with (e.g., sends signals to, receives signals from) the user 2450, the network manager 2480, and/or one or more of the sensors 2460. In some cases, the communication module 2408 accesses the stored data 2434 to determine which communication protocol is used to communicate with the sensor 2460 associated with the stored data 2434. In addition, the communication module 2408 can interpret the communication protocol of a communication received by the controller 2404 so that the control engine 2406 can interpret the communication.

The communication module 2408 can send and receive data between the network manager 2480, the sensors 2460, and/or the users 2450 and the controller 2404. The communication module 2408 can send and/or receive data in a given format that follows a particular protocol 2432. The control engine 2406 can interpret the data packet received from the communication module 2408 using the protocol 2432 information stored in the storage repository 2430. The control engine 2406 can also facilitate the data transfer between one or more sensors 2460 and the network manager 2480 or a user 2450 by converting the data into a format understood by the communication module 2408.

The communication module 2408 can send data (e.g., protocols 2432, algorithms 2433, stored data 2434, operational information, alarms) directly to and/or retrieve data directly from the storage repository 2430. Alternatively, the control engine 2406 can facilitate the transfer of data between the communication module 2408 and the storage repository 2430. The communication module 2408 can also provide encryption to data that is sent by the controller 2404 and decryption to data that is received by the controller 2404. The communication module 2408 can also provide one or more of a number of other services with respect to data sent from and received by the controller 2404. Such services can include, but are not limited to, data packet routing information and procedures to follow in the event of data interruption.

The timer 2410 of the controller 2404 can track clock time, intervals of time, an amount of time, and/or any other measure of time. The timer 2410 can also count the number of occurrences of an event, whether with or without respect to time. Alternatively, the control engine 2406 can perform the counting function. The timer 2410 is able to track multiple time measurements concurrently. The timer 2410 can track time periods based on an instruction received from the control engine 2406, based on an instruction received from the user 2450, based on an instruction programmed in the software for the controller 2404, based on some other condition or from some other component, or from any combination thereof.

The timer 2410 can be configured to track time when there is no power delivered to the controller 2404 (e.g., the power module 2412 malfunctions) using, for example, a super capacitor or a battery backup. In such a case, when there is a resumption of power delivery to the controller 2404, the timer 2410 can communicate any aspect of time to the controller 2404. In such a case, the timer 2410 can include one or more of a number of components (e.g., a super capacitor, an integrated circuit) to perform these functions.

The energy metering module 2439 of the controller 2404 measures one or more components of power (e.g., current, voltage, resistance, VARs, watts) at one or more points (e.g., output of each light load 2440 of the power supply 2402) associated with the light fixture 2409. The energy metering module 2439 can include any of a number of measuring devices and related devices, including but not limited to a voltmeter, an ammeter, a power meter, an ohmmeter, a current transformer, a potential transformer, and electrical wiring. The energy metering module 2439 can measure a component of power continuously, periodically, based on the occurrence of an event, based on a command received from the control module 2406, and/or based on some other factor. The energy metering module 2439 can be a type of sensor 2460.

The power module 2412 of the controller 2404 provides power to one or more other components (e.g., timer 2410, control engine 2406) of the controller 2404. In certain example embodiments, the power module 2412 receives power from the power supply 2402. Alternatively, as whan the power supply 2412 includes an independent source of power, the power module 2412 can provide power to the power supply 2402 of the light fixture 2409. The power module 2412 can include one or more of a number of single or multiple discrete components (e.g., transistor, diode, resistor), and/or a microprocessor. The power module 2412 may include a printed circuit board, upon which the microprocessor and/or one or more discrete components are positioned. In some cases, the power module 2412 can include one or more components that allow the power module 2412 to measure one or more elements of power (e.g., voltage, current) that is delivered to and/or sent from the power module 2412. Alternatively, the energy metering module 2439 can measure such elements of power.

The power module 2412 can include one or more components (e.g., a transformer, a diode bridge, an inverter, a converter) that receives power (for example, through an electrical cable) from a source external to the light fixture 2409 and generates power of a type (e.g., AC, DC) and level (e.g., 12V, 24V, 2420V) that can be used by the other components of the controller 2404 and/or by the power supply 2402. The power module 2412 can use a closed control loop to maintain a preconfigured voltage or current with a tight tolerance at the output. The power module 2412 can also protect the rest of the electronics (e.g., hardware processor 2420, transceiver 2424) in the light fixture 2409 from surges generated in the line.

In addition, or in the alternative, the power module 2412 can be a source of power in itself to provide signals to the other components of the controller 2404 and/or the power supply 2402. For example, the power module 2412 can be a battery. As another example, the power module 2412 can be a localized photovoltaic power system. The power module 2412 can also have sufficient isolation in the associated components of the power module 2412 (e.g., transformers, opto-couplers, current and voltage limiting devices) so that the power module 2412 is certified to provide power to an intrinsically safe circuit.

In certain example embodiments, the power module 2412 of the controller 2404 can also provide power and/or control signals, directly or indirectly, to one or more of the sensors 2460. In such a case, the control engine 2406 can direct the power generated by the power module 2412 to the sensors 2460 and/or the power supply 2402 of the light fixture 2409. In this way, power can be conserved by sending power to the sensors 2460 and/or the power supply 2402 of the light fixture 2409 when those devices need power, as determined by the control engine 2406.

The hardware processor 2420 of the controller 2404 executes software, algorithms, and firmware in accordance with one or more example embodiments. Specifically, the hardware processor 2420 can execute software on the control engine 2406 or any other portion of the controller 2404, as well as software used by the user 2450, the network manager 2480, and/or one or more of the sensors 2460. The hardware processor 2420 can be an integrated circuit, a central processing unit, a multi-core processing chip, SoC, a multi-chip module including multiple multi-core processing chips, or other hardware processor in one or more example embodiments. The hardware processor 2420 is known by other names, including but not limited to a computer processor, a microprocessor, and a multi-core processor.

In one or more example embodiments, the hardware processor 2420 executes software instructions stored in memory 2422. The memory 2422 includes one or more cache memories, main memory, and/or any other suitable type of memory. The memory 2422 can include volatile and/or non-volatile memory. The memory 2422 is discretely located within the controller 2404 relative to the hardware processor 2420 according to some example embodiments. In certain configurations, the memory 2422 can be integrated with the hardware processor 2420.

In certain example embodiments, the controller 2404 does not include a hardware processor 2420. In such a case, the controller 2404 can include, as an example, one or more field programmable gate arrays (FPGA), one or more insulated-gate bipolar transistors (IGBTs), and/or one or more ICs. Using FPGAs, IGBTs, ICs, and/or other similar devices known in the art allows the controller 2404 (or portions thereof) to be programmable and function according to certain logic rules and thresholds without the use of a hardware processor. Alternatively, FPGAs, IGBTs, ICs, and/or similar devices can be used in conjunction with one or more hardware processors 2420.

The transceiver 2424 of the controller 2404 can send and/or receive control and/or communication signals. Specifically, the transceiver 2424 can be used to transfer data between the controller 2404 and the user 2450, the network manager 2480, and/or the sensors 2460. The transceiver 2424 can use wired and/or wireless technology. The transceiver 2424 can be configured in such a way that the control and/or communication signals sent and/or received by the transceiver 2424 can be received and/or sent by another transceiver that is part of the user 2450, the network manager 2480, and/or the sensors 2460. The transceiver 2424 can use any of a number of signal types, including but not limited to radio signals.

When the transceiver 2424 uses wireless technology, any type of wireless technology can be used by the transceiver 2424 in sending and receiving signals. Such wireless technology can include, but is not limited to, Wi-Fi, visible light communication, cellular networking, and Bluetooth. The transceiver 2424 can use one or more of any number of suitable communication protocols (e.g., ISA100, HART) when sending and/or receiving signals. Such communication protocols can be stored in the communication protocols 2432 of the storage repository 2430. Further, any transceiver information for the user 2450, the network manager 2480, and/or the sensors 2460 can be part of the stored data 2434 (or similar areas) of the storage repository 2430.

Optionally, in one or more example embodiments, the security module 2428 secures interactions between the controller 2404, the user 2450, the network manager 2480, and/or the sensors 2460. More specifically, the security module 2428 authenticates communication from software based on security keys verifying the identity of the source of the communication. For example, user software may be associated with a security key enabling the software of the user 2450 to interact with the controller 2404 and/or the sensors 2460. Further, the security module 2428 can restrict receipt of information, requests for information, and/or access to information in some example embodiments.

As mentioned above, aside from the controller 2404 and its components, the light fixture 2409 can include the sensors 2460, the light loads 2440, the switches 2442, and the power supply 2402. Each light load 2440 can include an array of one or more light sources. If a light load 2440 has multiple light sources, those light sources can be arranged in series and/or in parallel with respect to each other. Further, when a light fixture 2409 has multiple light loads 2440, the multiple light loads 2440 can be arranged in series and/or in parallel with respect to each other.

Each light load 2440 of the light fixture 2409 can include devices and/or components typically found in a light fixture to allow the light fixture 2409 to operate. Examples of such devices and/or components of a light load 2440 can include, but are not limited to, a light source, a local control module, a light engine, a heat sink, an electrical conductor or electrical cable, a light array, a terminal block, a lens, a diffuser, a reflector, an air moving device, a baffle, a dimmer, and a circuit board. The light load 2440 can include any type of lighting technology, including but not limited to LED, incandescent, sodium vapor, and fluorescent.

The power supply 2402 of the light fixture 2409 provides power to the light loads 2440. The power supply 2402 can be called by any of a number of other names, including but not limited to a driver, a LED driver, and a ballast. The power supply 2402 can be substantially the same as, or different than, the power module 2412 of the controller 2404. The power supply 2402 can include one or more of a number of single or multiple discrete components (e.g., transistor, diode, resistor), and/or a microprocessor. The power supply 2402 may include a printed circuit board, upon which the microprocessor and/or one or more discrete components are positioned, and/or a dimmer.

A power supply 2402 can include one or more components (e.g., a transformer, a diode bridge, an inverter, a converter) that receives power (for example, through an electrical cable) from the power module 2412 of the controller 2404 and generates power of a type (e.g., AC, DC) and level (e.g., 12V, 24V, 2420V) that can be used by the light load 2440. In addition, or in the alternative, the power supply 2402 can receive power from a source external to the light fixture 2409. In addition, or in the alternative, the power supply 2402 can be a source of power in itself. For example, the power supply 2402 can be a battery, a localized photovoltaic power system, or some other source of independent power.

As shown in FIG. 24A, the switches 2442 determine which light loads 2440 receive power from the power supply 2402 at any particular point in time. A switch 2442 has an open state and a closed state (position). In the open state, the switch 2442 creates an open circuit, which prevents the power supply 2402 from delivering power to one or more of the associated downstream light load 2440. In the closed state, the switch 2442 creates a closed circuit, which allows the power supply 2402 to deliver power to one or more of the associated downstream light load 2440. In certain example embodiments, the position of each switch 2442 is controlled by the control engine 2406 of the controller 2404.

Each switch 2442 can be any type of device that changes state or position (e.g., opens, closes) based on certain conditions. Examples of a switch 2442 can include, but are not limited to, a transistor (e.g., a field-effect transistor (FET)), a dipole switch, a relay contact, a resistor, and a NOR gate. In certain example embodiments, each switch 2442 can operate (e.g., change from a closed position to an open position, change from an open position to a closed position) based on input from the controller 2404.

As stated above, the light fixture 2409 can be placed in any of a number of environments. In such a case, the housing 2403 of the light fixture 2409 can be configured to comply with applicable standards for any of a number of environments. For example, the light fixture 2409 can be rated as a Division 1 or a Division 2 enclosure under NEC standards. Similarly, any of the sensors 2460 or other devices communicably coupled to the light fixture 2409 can be configured to comply with applicable standards for any of a number of environments. For example, a sensor 2460 can be rated as a Division 1 or a Division 2 enclosure under NEC standards.

Figure 25:
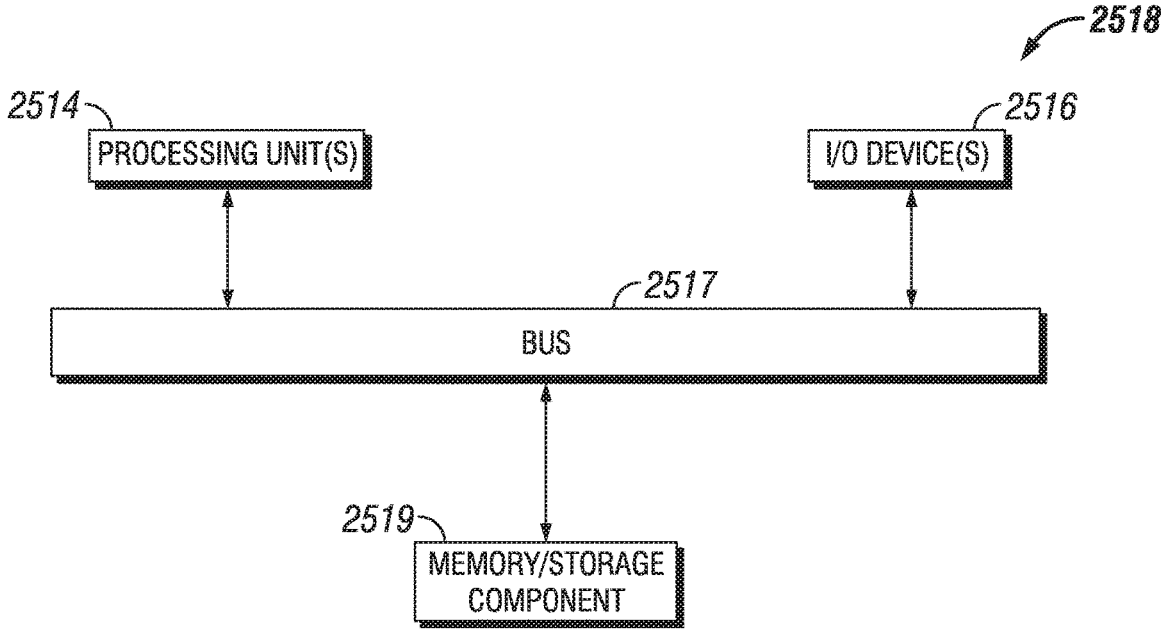
FIG. 25 shows a computing device in accordance with certain example embodiments.

FIG. 25 illustrates one embodiment of a computing device 2518 that implements one or more of the various techniques described herein, and which is representative, in whole or in part, of the elements described herein pursuant to certain example embodiments. Computing device 2518 is one example of a computing device and is not intended to suggest any limitation as to scope of use or functionality of the computing device and/or its possible architectures. Neither should computing device 2518 be interpreted as having any dependency or requirement relating to any one or combination of components illustrated in the example computing device 2518.

Computing device 2518 includes one or more processors or processing units 2514, one or more memory/storage components 2519, one or more input/output (I/O) devices 2516, and a bus 2517 that allows the various components and devices to communicate with one another. Bus 2517 represents one or more of any of several types of bus structures, including a memory bus or memory controller, a peripheral bus, an accelerated graphics port, and a processor or local bus using any of a variety of bus architectures. Bus 2517 includes wired and/or wireless buses.

Memory/storage component 2519 represents one or more computer storage media. Memory/storage component 2519 includes volatile media (such as random access memory (RAM)) and/or nonvolatile media (such as read only memory (ROM), flash memory, optical disks, magnetic disks, and so forth). Memory/storage component 2519 includes fixed media (e.g., RAM, ROM, a fixed hard drive, etc.) as well as removable media (e.g., a Flash memory drive, a removable hard drive, an optical disk, and so forth).

One or more I/O devices 2516 allow a customer, utility, or other user to enter commands and information to computing device 2518, and also allow information to be presented to the customer, utility, or other user and/or other components or devices. Examples of input devices include, but are not limited to, a keyboard, a cursor control device (e.g., a mouse), a microphone, a touchscreen, and a scanner. Examples of output devices include, but are not limited to, a display device (e.g., a monitor or projector), speakers, outputs to a lighting network (e.g., DMX card), a printer, and a network card.

Various techniques are described herein in the general context of software or program modules. Generally, software includes routines, programs, objects, components, data structures, and so forth that perform particular tasks or implement particular abstract data types. An implementation of these modules and techniques are stored on or transmitted across some form of computer readable media. Computer readable media is any available non-transitory medium or non-transitory media that is accessible by a computing device. By way of example, and not limitation, computer readable media includes "computer storage media".

"Computer storage media" and "computer readable medium" include volatile and non-volatile, removable and non-removable media implemented in any method or technology for storage of information such as computer readable instructions, data structures, program modules, or other data. Computer storage media include, but are not limited to, computer recordable media such as RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which is used to store the desired information and which is accessible by a computer.

The computer device 2518 is connected to a network (not shown) (e.g., a LAN, a WAN such as the Internet, cloud, or any other similar type of network) via a network interface connection (not shown) according to some example embodiments. Those skilled in the art will appreciate that many different types of computer systems exist (e.g., desktop computer, a laptop computer, a personal media device, a mobile device, such as a cell phone or personal digital assistant, or any other computing system capable of executing computer readable instructions), and the aforementioned input and output means take other forms, now known or later developed, in other example embodiments. Generally speaking, the computer system 2518 includes at least the minimal processing, input, and/or output means necessary to practice one or more embodiments.

Further, those skilled in the art will appreciate that one or more elements of the aforementioned computer device 2518 is located at a remote location and connected to the other elements over a network in certain example embodiments. Further, one or more embodiments is implemented on a distributed system having one or more nodes, where each portion of the implementation (e.g., control engine 2406) is located on a different node within the distributed system. In one or more embodiments, the node corresponds to a computer system. Alternatively, the node corresponds to a processor with associated physical memory in some example embodiments. The node alternatively corresponds to a processor with shared memory and/or resources in some example embodiments.

Example embodiments described herein can provide improved reliability and performance of light fixtures and other devices that use light sources. Example embodiments can lower operating temperatures of certain components, thereby extending their useful life. Example embodiments can measure and track data associated with a number of components, thereby identifying when those components are failing. Example embodiments can also identify when a component has failed. In either case, example embodiments can avoid using these failed components or limit the use of these failing components to improve the reliability of the light fixture or other device. By utilizing a lower power factor, example embodiments can achieve these efficiencies without a discernable degradation in light output.

Although embodiments described herein are made with reference to example embodiments, it should be appreciated by those skilled in the art that various modifications are well within the scope and spirit of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the present invention is not limited herein.

What is claimed is:

1. A device comprising:

a plurality of light loads, wherein each light load of the plurality of light loads comprises at least one light source;

a plurality of switches coupled to the plurality of light loads; and a controller coupled to the plurality of switches, wherein the controller actively operates the plurality of switches multiple times within each cycle to control delivery of power to the plurality of light loads, wherein each cycle is at most approximately $1/50^{th}$ of a second, wherein active operation of the plurality of switches by the controller is performed on a dynamic schedule, wherein the dynamic schedule is based on a plurality of environmental conditions, wherein the controller bypasses a forward voltage of the plurality of light loads when actively operating the plurality of switches, and wherein the controller controls the plurality of switches on a first on, first off basis.

2. The device of claim 1, wherein the at least one light source comprises a light-emitting diode.

3. The device of claim 1, wherein input power delivered to the device is nominally between 120 VAC and 480 VAC.

4. The device of claim 1, wherein the at least one switch comprises a field-effect transistor.

5. The device of claim 1, further comprising:

at least one additional switch coupled to the controller and disposed in parallel with at least one light load of the plurality of light loads, wherein the controller operates the at least one additional switch to further control delivery of the power to the at least one light load of the plurality of light loads.

6. The device of claim 1, further comprising:

at least one energy storage device coupled to at least one light load of the plurality of light loads, wherein the at least one energy storage device provides reserve power to the at least one light load when the plurality of switches prevents the power from being delivered to the at least one light load.

7. The device of claim 1, further comprising:

at least one sensor coupled to the controller, wherein the at least one sensor measures the plurality of environmental conditions, wherein at least one parameter corresponds to the plurality of environmental conditions, wherein the controller actively operates the plurality of switches based, at least in part, on measurements made by the at least one sensor.

8. The device of claim 7, wherein the plurality of environmental conditions comprises at least one selected from a group consisting of a current and a voltage, wherein the controller determines whether a light load of the plurality of light loads has failed, wherein the controller isolates the light load that has failed.

9. The device of claim 7, wherein the plurality of environmental conditions comprises at least one selected from a group consisting of a current and a voltage, wherein the controller determines whether a light load of the plurality of light loads is beginning to fail, wherein the controller reduces utilization of the light load that is beginning to fail.

10. The device of claim 7, wherein the plurality of environmental conditions comprises at least one selected from a group consisting of a current and a voltage, wherein the controller identifies a short circuit in at least one light load of the plurality of light loads, wherein the controller isolates at least one light load with the short circuit.

11. The device of claim 7, wherein the plurality of environmental conditions comprises at least one selected from a group consisting of a current and a voltage, wherein the controller identifies an open circuit in at least one light load of the plurality of light loads, wherein the controller isolates at least one light load with the open circuit.

12. The device of claim 7, wherein the plurality of environmental conditions comprises a temperature, wherein the controller determines whether a light load of the plurality of light loads has a temperature that exceeds a first threshold value, wherein the controller reduces utilization of the light load.

13. The device of claim 12, wherein the controller determines whether a light load of the plurality of light loads has a temperature that exceeds a second threshold value, wherein the second threshold value is greater than the first threshold value, wherein the controller isolates the light load.

14. The device of claim 1, wherein a power factor of the plurality of light loads is at least 0.9.

15. A method for dynamically regulating power for a lighting system, the method comprising:

receiving a plurality of environmental conditions measured by a plurality of sensors;

operating, at a first time within a cycle, at least one first switch of a plurality of switches based on the plurality of environmental conditions, wherein operating the at least one first switch allows a first current to flow through a first subset of light loads and prevents the first current from flowing through a first remainder of light loads, wherein the first remainder of light loads receives power from a first remainder of energy storage devices; and operating, at a second time within the cycle, at least one second switch of the plurality of switches based on the plurality of environmental conditions, wherein operating the at least one second switch allows a second current to flow through a second subset of light loads and prevents the second current from flowing through a second remainder of light loads, wherein the second remainder of light loads receives power from a second remainder of energy storage devices, wherein the cycle is at most approximately $1/50^{th}$ of a second, and wherein the controller controls the plurality of switches on a first on, first off basis.

16. The method of claim 15, wherein operating the at least one second switch at the second time within the cycle is further based on an additional plurality of environmental conditions measured by the plurality of sensors.

17. The method of claim 15, wherein the first current further flows through a first subset of energy storage devices to charge the first subset of energy storage devices.

18. The method of claim 15, wherein the first subset of light loads and the second subset of light loads change over time based on the plurality of environmental conditions.

19. The method of claim 15, wherein the first subset of light loads and the second subset of light loads change over time based on operating history of each of the plurality of light loads.

20. A device comprising:

a plurality of light loads, wherein each light load of the plurality of light loads comprises at least one light source;

a plurality of switches coupled to the plurality of light loads; and a controller coupled to the plurality of switches, wherein the controller actively operates the plurality of switches multiple times within each cycle to control delivery of power to the plurality of light loads, wherein each cycle is a fraction of a second, wherein active operation of the plurality of switches by the controller is performed on a dynamic schedule, wherein the dynamic schedule is based on real-time changes in at least one of a plurality of environmental conditions that are independent of a dimming function, wherein the controller bypasses a forward voltage of the plurality of light loads when actively operating the plurality of switches, and wherein the controller controls the plurality of switches on a first on, first off basis.

* * * * *